US006330411B1

(12) United States Patent
Suzuki

(10) Patent No.: US 6,330,411 B1
(45) Date of Patent: Dec. 11, 2001

(54) REPLENISHING CONTAINER FOR REPLENISHING CHARGING PARTICLES AND TONER

(75) Inventor: Hiroyuki Suzuki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/620,476

(22) Filed: Jul. 20, 2000

(30) Foreign Application Priority Data

Jul. 29, 1999 (JP) ..... 11-215077

(51) Int. Cl.[7] ..... G03G 15/02; G03G 15/08
(52) U.S. Cl. ..... 399/120; 399/175; 399/262
(58) Field of Search ..... 399/120, 262, 399/174–176

(56) References Cited

U.S. PATENT DOCUMENTS 4,851,960 7/1989 Nakamura et al. ..... 361/225
5,450,178 * 9/1995 Kawashima et al. ..... 399/262
5,459,559 10/1995 Nagase et al. .
5,809,379 9/1998 Yano et al. ..... 399/159
5,907,752 * 5/1999 Kondoh ..... 399/120
6,097,910 * 8/2000 Sasaki et al. ..... 399/262 X

FOREIGN PATENT DOCUMENTS 3-52058 8/1991 (JP) .
6-3921 1/1994 (JP) .

* cited by examiner

*Primary Examiner*—William J. Royer
(74) *Attorney, Agent, or Firm*—Fitzpatrick, Cella, Harper & Scinto

(57) ABSTRACT

A replenishing container has a first chamber for containing a toner to be replenished to a developing device, and a second chamber for containing magnetic particles to be replenished to a charging device.

4 Claims, 14 Drawing Sheets

REPLENISHING CONTAINER FOR REPLENISHING CHARGING PARTICLES AND TONER

BACKGROUND OF THE INVENTION

1. Field of the Invention

The present invention relates to a replenishing container for replenishing image forming apparatuses such as a copying machine and a printer using an electrophotographic system and an electrostatic recording system with toner and charging particles.

2. Related Background Art

FIG. 15 is a schematic view showing one example of a transferring system electrophotographic apparatus (a copying machine, a printer, a facsimile machine, or the like) as a conventional example of an image forming apparatus.

A rotary drum type electrophotosensitive body (hereinafter referred to as the photosensitive drum) 111 is a first image bearing member and is rotated/driven in a clockwise direction shown by an arrow with a predetermined peripheral speed.

The photosensitive drum 111 is subjected to a uniform charging process with a predetermined uniform polarity and potential by charging means 112 in its process of rotation. The charging means 112 is a charging roller as a contact charging member in this example. Subsequently, the photosensitive drum receives image exposing light L by image exposing means (original image projection exposing means, laser scan exposing means, and the like) (not shown). In this case, electricity is removed (or potential is attenuated) selectively from the uniformly charged surface of the photosensitive drum 111 in accordance with an exposed image pattern, and an electrostatic latent image is formed on the surface of the photosensitive drum 111.

Subsequently, the electrostatic latent image is developed as a toner image by developing means 113.

On the other hand, a transferring material (transferring sheet) P as a second image bearing member is fed to a transferring portion between the photosensitive drum 111 and a transferring means 114 from a sheet feeding mechanism (not shown) at a predetermined control timing, and the toner image on the surface of the photosensitive drum 111 is successively transferred to the surface of the fed transferring material P. The transferring means 114 is a transferring roller in this example.

Subsequently, the transferring material P is detached from the surface of the rotary photosensitive drum 111, introduced to fixing means (not shown), subjected to a fixing process of the toner image and outputted as an image formed material (copy, print).

After the toner image is transferred to the transferring material P, the surface of the photosensitive drum 111 is cleaned by a cleaning apparatus (cleaner) 115, a transfer residual toner is removed from the surface, and the photosensitive drum is repeatedly used for image formation.

1) Contact Charging Device

In the aforementioned image forming apparatus, as the photosensitive drum 111, and the respective means/apparatuses 112 to 115 for the image forming processes such as charging, exposing, developing, transferring, cleaning, and fixing, there are various systems/constitutions.

For example, as the charging means 112 for uniformly charging the surface of the photosensitive drum 111 with the predetermined polarity/potential, a corona charging device has been generally used. This corona charging device is disposed opposite to the photosensitive drum in a non-contact manner, and the surface of the photosensitive drum is exposed to a corona shower generated from the corona charging device with a high pressure applied thereto so that the surface of the rotary photosensitive drum is charged to provide the predetermined polarity/potential.

In recent years, a contact charging device has been put into practical use because of its advantages such as low ozone and low power rather than the corona charging device.

For the contact charging device, an electrically conductive member with an adjusted resistivity is used as a contact charging member and is brought in contact with a body to be charged, a predetermined voltage (charging bias) is applied to the contact charging member, and the surface of the body to be charged is charged to provide the predetermined polarity/potential.

As the contact charging member, a roller type constituted of a rolled electrically conductive rubber (charging roller, electrically conductive rubber roller), a blade type constituted of a bladed electrically conductive rubber (charging blade), a magnetic brush type using magnetic particles, a fur brush type constituted by forming electrically conductive fibers in a brush shape, and other various types are preferably used.

For the magnetic brush charging device, electrically conductive magnetic particles are directly carried by a magnet or magnetically bound/held on a sleeve incorporating the magnet as a magnetic brush, the magnetic brush portion of the magnetic particles is stopped or rotated to contact the surface of the body to be charged, and a voltage is applied to the surface to contact-charge the surface of the body to be charged, which is preferably used from the viewpoint of the stability of charging/contact.

For the charging bias to be applied to the contact charging member, there are a DC bias application system in which only a direct-current voltage is used, and an AC bias application system in which a vibration voltage containing a direct-current bias component and an alternating bias component is used.

2) Injection Charging

The contact charging includes a system in which the charging by a discharge phenomenon is dominant as disclosed in Japanese Patent Publication No. 3-52058, and a system in which the charging by direct injection (charging) of an electric charge with respect to the surface of the body to be charged is dominant as disclosed in Japanese Patent Application Laid-Open No. 6-3921 or the like (charge injection charging system).

In the electric charge injection charging system, the contact charging member described above is used, a charge injection charging type is used as the body to be charged, and a usual organic photosensitive body provided with a surface layer with electrically conductive fine particles dispersed therein, an amorphous silicon photosensitive body, or the like is used as the image bearing member, so that the charging potential substantially equal to that of the direct-current component of the bias applied to the contact charging member can be obtained on the surface of the body to be charged.

In the charge injection charging system, since the discharge phenomenon effected by using the corona charging device is not utilized during the charging of the body to be charged, the charging bias required to be applied is only for the desired surface potential of the body to be charged. A completely ozone-less charging in which no ozone is generated, and a low power consumption charging are possible, and the system has been noted.

In the image forming apparatus of the magnetic brush contact charging system and the transferring system, when image formation is repeated, contamination of the magnetic particles of the magnetic brush as the contact charging member occurs, and deterioration of charging property is seen.

The contamination of the magnetic particles of the magnetic brush is caused when toner particle resin components are fused to adhere to the magnetic particles because of a usually relatively high electric resistance of the toner particles, or when an external application agent applied to the toner particles from the outside adheres to the toner particles. This phenomenon raises the resistance of the magnetic particles, the image bearing member as the body to be charged cannot be charged to provide a desired potential, unevenness of charging occurs, and an image defect is generated.

SUMMARY OF THE INVENTION

An object of the present invention is to provide a replenishing container which can replenish toner and charging particles.

Another object of the present invention is to provide an image forming apparatus in which a high charging ability can be obtained over a long period.

A further object of the present invention is to provide a replenishing container comprising a first chamber for containing a toner to be replenished to developing means and a second chamber for containing magnetic particles to be replenished to charging means.

Other objects of the present invention will be apparent from the following description.

DESCRIPTION OF THE PREFERRED EMBODIMENTS

<First Embodiment>(FIGS. 1 to 9)

Figure 1:
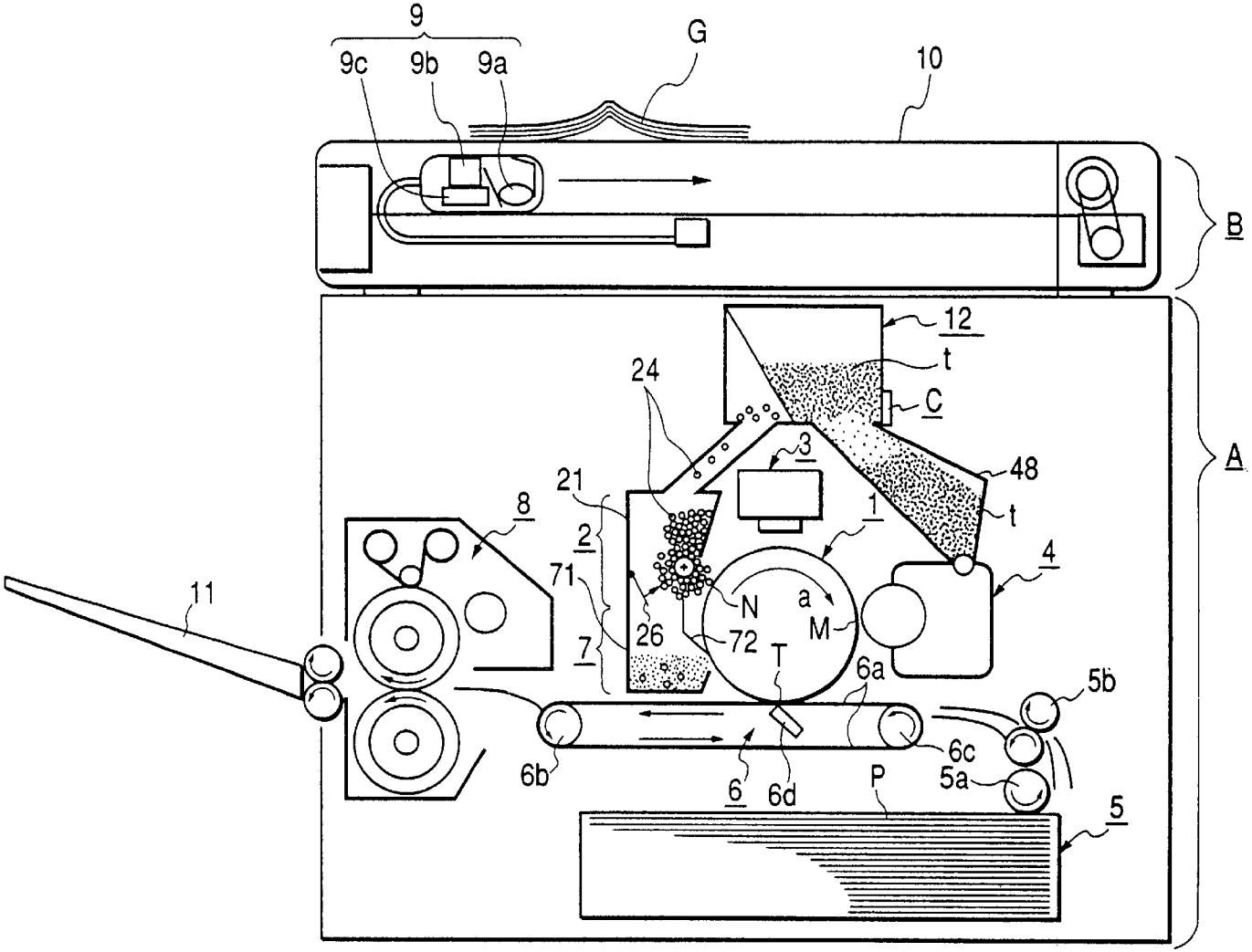
FIG. 1 is a schematic view of an image forming apparatus according to a first embodiment.

FIG. 1 is a sectional view of an image forming apparatus according to the present invention.

The image forming apparatus of the present embodiment is a printer in which a transferring type electrophotographic process is utilized, and a magnetic brush contact charging system, LED exposing system, and reversal developing system are used.

In FIG. 1, character A denotes a printer portion, and an image reader portion (image reading apparatus) B is mounted/installed on the printer portion.

(1) Image Reader Portion B

In the image reader portion B, numeral 10 denotes a fixed original stand (transparent plate of glass or the like), an original G is laid on the top surface of the original stand with a surface to be copied facing downward and an original press plate (not shown) is placed on the original.

An image reading unit 9 is provided with an original irradiating lamp 9*a,* short focus lens array 9*b,* and CCD sensor 9*c*. When a copy start signal is inputted, the unit 9 is moved forward along the under surface of the original stand to the right side from a home position on the left side of the original stand under the original stand 10 to reach a predetermined forward movement end point, and is moved backward and returned to the initial home position.

In the process of forward movement driving of the unit 9, the downward facing image surface of the original G laid on the original stand 10 is successively irradiated/scanned to the right side from the left side by the original irradiating lamp 9*a* of the unit 9, and an irradiation scanning light reflected by the original surface is incident upon the CCD sensor 9*c* via the short focus lens array 9*b* to form an image.

The CCD sensor 9*c* is constituted of a light receiving portion, transferring portion, and outputting portion. The CCD light receiving portion converts a light signal to a charge signal, the transferring portion successively transfers the signal to the outputting portion in synchronization with a clock pulse, and the outputting portion converts the charge signal to a voltage signal, amplifies the signal, lowers impedance and outputs the signal. An analog signal obtained in this manner is subjected to a known image processing, converted to a digital signal, and transmitted to the printer portion A.

Specifically, the image reader portion B photoelectrically reads image information on the original G as a time series electric digital pixel signal (image signal).

(2) Printer Portion A

Numeral 1 denotes a rotary drum type electrophotographic photosensitive body (photosensitive drum) as a first image bearing member. This photosensitive drum 1 is rotated/driven centering on a center support shaft with a predetermined peripheral speed in a clockwise direction shown by an arrow a. The photosensitive drum 1 of the present embodiment is an organic photosensitive body having a diameter of about 30 mm and having a charge injection charging property and negative charging property, and is rotated/driven with a peripheral speed of 100 mm/sec. For the photosensitive drum 1, a layer structure will be described later.

a. Charging: The photosensitive drum 1 is subjected to a primary charging process in its rotation process and its outer peripheral surface is uniformly charged substantially to provide −650 V by a magnetic brush charging device 2.

b. Exposing: Subsequently, with respect to the uniformly charged surface of the rotary photosensitive drum 1, image information is scanned/exposed by an LED exposing device 3 as latent image forming means (exposing means, exposing apparatus), and electrostatic latent images are successively formed on the surface of the rotary photosensitive drum 1 in accordance with the image information of the original G photoelectrically read by the image reader portion B.

Specifically, the LED exposing device 3 is a light emitting element array constituted by arranging a large number of LEDs in a main scan direction of the photosensitive drum 1, and light emission of the individual LEDs of the LED exposing device 3 is controlled to selectively turn on/off in accordance with the image signal transmitted to the printer portion A from the image reader portion B. With sub-scanning by the rotation of the photosensitive drum 1, on the surface of the photosensitive drum 1, the potential of an exposed portion by the emission of LED drops (light portion potential), and in contrast with the potential of a non-exposed portion (dark portion potential), the electrostatic latent image is formed in accordance with an exposing pattern.

c. Developing: The electrostatic latent image formed on the surface of the rotary photosensitive drum 1 is successively reversal-developed as a toner image by a developing device 4 as developing means in the present embodiment. For the developing device 4, a constitution will be described later.

d. Transferring: On the other hand, transferring materials P as a second image bearing member stacked/contained in a sheet feeding cassette 5 are drawn and fed one by one by a sheet feeding roller 5*a,* and fed to a transferring portion T as a contact nip portion of the photosensitive drum 1 and a transferring apparatus 6 as transferring means by a registration roller 5*b* in a predetermined control timing, and a toner image on the surface of the photosensitive drum 1 is electrostatically transferred to the surface of the transferring material P.

In the present embodiment, the transferring apparatus 6 is a belt transferring apparatus, and an endless transferring belt 6*a* is extended between a driving roller 6*b* and a driven roller 6*c,* and rotated/driven in a counterclockwise direction shown by an arrow with substantially the same peripheral speed as the rotation peripheral speed of the photosensitive drum 1. A transfer charging blade 6*d* is disposed inside the endless transferring belt 6*a,* and this blade 6*d* brings substantially the middle portion of the upper line side belt portion of the belt 6*a* into contact with the surface of the photosensitive drum 1 to form the transferring portion T.

The transferring material P is laid on the top surface of the upper line side belt portion of the belt 6*a* and conveyed to the transferring portion T. When the tip end of the conveyed transferring material P enters the transferring portion T, a predetermined transferring bias is supplied to the transfer charging blade 6*d* from a transferring bias application power source (not shown), charging is performed from the back side of the transferring material P with a polarity reverse to the polarity of a toner, and the toner image on the photosensitive drum 1 is successively transferred to the top surface of the transferring material P.

e. Fixing: The transferring belt 6*a* also serves as means for conveying the transferring material P to a heat roller type fixing device 8 as fixing means in the present embodiment from the transferring portion T, and the transferring material P passed through the transferring portion T is detached from the surface of the rotary photosensitive drum 1, conveyed/introduced to the fixing device 8 by the transferring belt 6*a,* subjected to thermal fixing of the toner image and discharged to a discharged sheet tray 11 as a copy or a print.

f. Cleaning: Moreover, after the toner image is transferred to the transferring material P (the transferring material is detached), the surface of the rotary photosensitive drum 1 is subjected to removal of a transfer residual toner or another adhering contaminant remaining on the drum surface by a cleaner (cleaning apparatus) 7 and cleaned, and the drum is repeatedly used for image formation.

The cleaner 7 of the present embodiment is of a blade type, and scrapes and removes the adhering contaminants such as the transfer residual toner from the surface of the photosensitive drum 1 by allowing a cleaning blade 72 to abut on the surface of the photosensitive drum 1 with a predetermined pressing force and wiping the surface of the rotating photosensitive drum 1 with a blade edge. The adhering contaminants such as the transfer residual toner scraped from the surface of the photosensitive drum 1 are contained in a cleaning container 71.

(3) Photosensitive Drum 1

As the photosensitive drum 1 which is the first image bearing member, a usually used organic photosensitive body or the like can be used, but preferably use of the organic photosensitive body provided with a surface layer of a material having a resistance of $10^9$ to $10^{14}$ Ω·cm or an amorphous silicon photosensitive body provided with a surface layer including amorphous silicon can realize charge injection charging, effectively prevents ozone generation, and effectively reduces power consumption. Moreover, charging property can also be enhanced.

Figure 2:
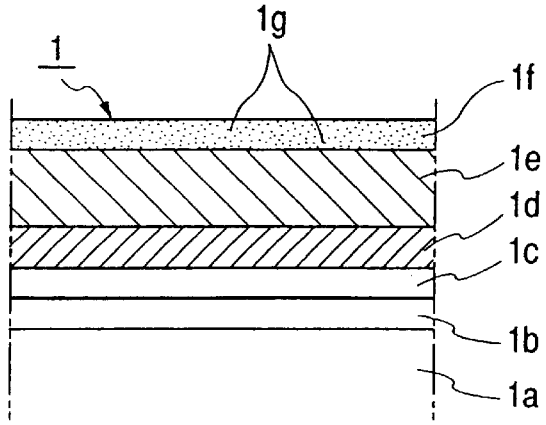
FIG. 2 is a schematic view of a photosensitive drum layer structure.

In the present embodiment the photosensitive drum 1 is an organic photosensitive body provided with the charge injection charging property and negative charging property, and as shown in the schematic view of the layer structure in FIG. 2, the following first to fifth layers 1*b* to 1*f* are formed in order from below on an aluminum drum base (aluminum base) 1*a* with a diameter of 30 mm.

The first layer 1*b* is an undercoating layer, and is an electrically conductive layer with a thickness of 20 μm disposed for smoothing defects and the like of the drum base 1*a*.

The second layer 1*c* is a positive charge injection preventive layer, plays a role of preventing a positive charge injected from the drum base 1*a* from canceling a negative charge on the photosensitive body surface, and is a medium-resistance layer having a thickness of 1 μm whose resistance is adjusted to provide about $1\times10^6$ Ω·cm by amylane resin and methoxymethyl nylon.

The third layer 1*d* is a charge producing layer, and produces a pair of positive and negative charges by being exposed by a layer having a thickness of about 0.3 μm in which disazo-based pigment is dispersed in resin.

The fourth layer 1*e* is a charge transporting layer constituted by dispersing hydrazone in polycarbonate resin, and is a P-type semiconductor. Therefore, the negative charge on the photosensitive body surface cannot move in this layer and only the positive charge produced in the charge producing layer can be transported to the photosensitive body surface.

The fifth layer 1*f* is a charge injecting layer, and is a layer formed by applying a material in which 1 g of $SnO_2$ microfine particles as electrically conductive particles are dispersed in an insulating resin binder. Specifically, insulating resin is doped with antimony as an electrically conductive filler provided with light transmission properties, and low-resistance (electrically conductive) $SnO_2$ particles with a particle diameter of 0.03 $\mu$m are dispersed in resin by 70% by weight. The application liquid prepared in this manner is applied in a thickness of about 3 $\mu$m to form the charge injecting layer by appropriate application methods such as dipping, spraying, rolling, and beaming.

(4) Magnetic Brush Charging Device 2

Figure 3B:
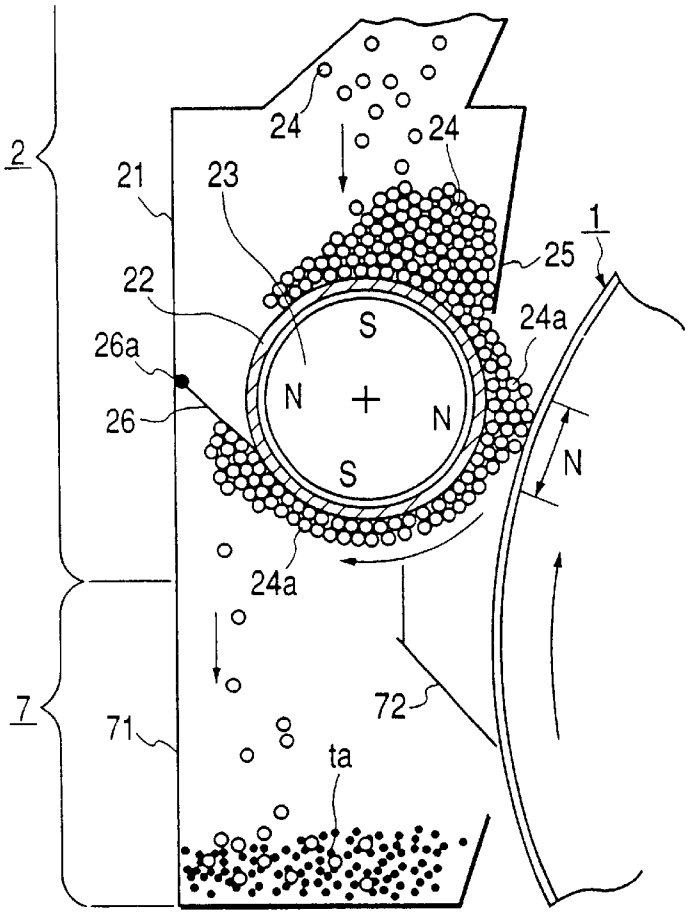
FIGS. 3A and 3B are schematic views showing a charging device.
Figure 3A:
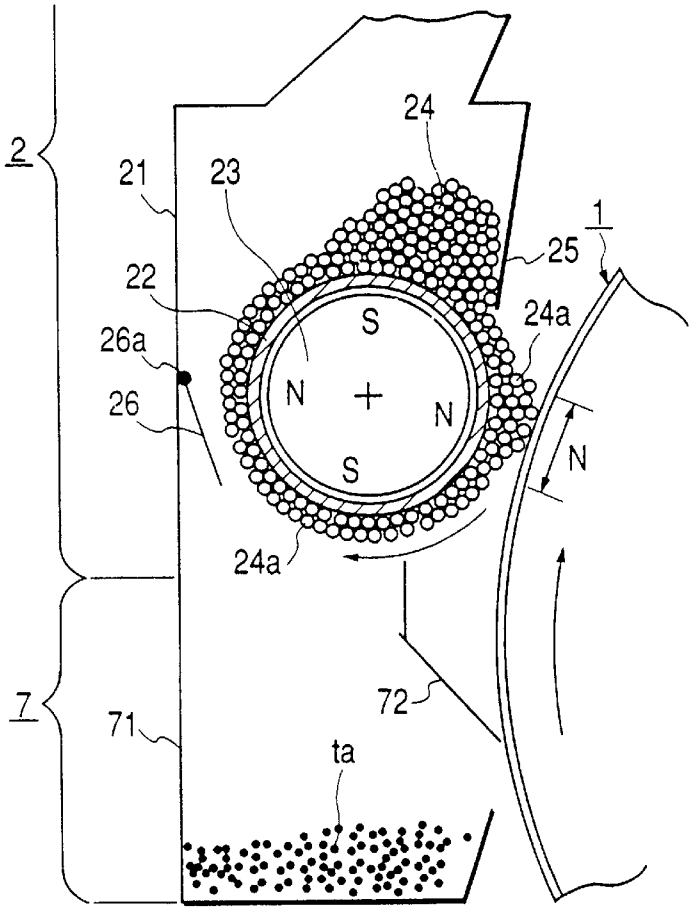
Figure 5:
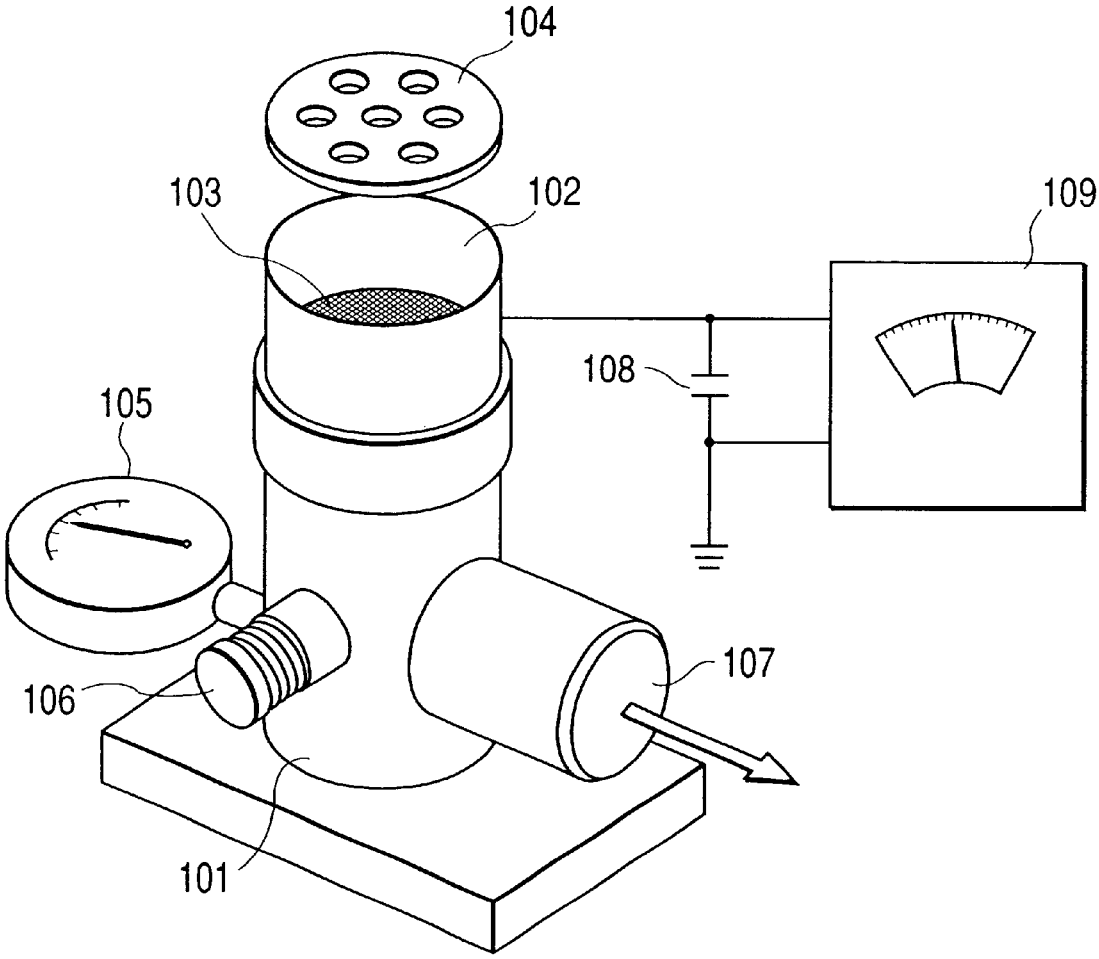
FIG. 5 is an explanatory view of a measuring instrument for use in measuring a toner charge amount.

FIGS. 3A and 3B are partial enlarged schematic views of the magnetic brush charging device 2, and a sleeve rotary type is used in the present embodiment.

Numeral 21 denotes a charging device container.

A nonmagnetic sleeve (hereinafter referred to as the charging sleeve) 22 as a magnetic brush carrying member has an outer size of 16 mm, a part of the sleeve is exposed to the outside, and the sleeve is rotatably disposed in the charging device container 21.

A magnet roller 23 as magnetic field generating means is inserted into the charging sleeve 22 and fixed in a non-rotatable manner, and the charging sleeve 22 is rotated/driven around the outer periphery of the fixed magnet roller 23 at a rotation speed of 150 mm/sec in a clockwise direction of an arrow which is counter to the direction of the photosensitive drum 1 rotating at a rotation speed of 100 m/sec.

Charging magnetic particles (hereinafter referred to as the charging carrier) 24 are contained in the charging device container 21, and the amount is set by adding an appropriate allowance to the amount to be carried as the magnetic brush on the peripheral surface of the charging sleeve 22. Specifically, in the present embodiment, the amount is larger than the charging carrier amount of magnetic brush for one lap of the charging sleeve 22, and 40 g of the charging carrier is contained.

A magnetic brush layer thickness regulating member (regulating blade) 25 is disposed in an opening in the charging device container 21, and is attached opposite to the charging sleeve 22 with a predetermined slight gap therefrom. This regulating member 25 is magnetically bound and carried as the magnetic brush on the charging sleeve 22 by the magnetic field of the magnet roller 23 in the sleeve, and regulates the amount of charging carrier (the layer thickness of the magnetic brush) rotated and carried out of the charging device container 21 with the rotation of the charging sleeve 22 in a predetermined manner so that a magnetic brush 24*a* of an adequate amount of charging carrier is formed.

Numeral 26 denotes a charging carrier stripping member for stripping at least a part of the charging carrier from the magnetic brush of the charging carrier magnetically bound and carried on the charging sleeve 22. In the present embodiment the stripping member is a blade member rotatable centering on a hinge portion 26*a* in the charging device container 21. For example, by controlling driving means (not shown) such as an electromagnetic solenoid and a stepping motor by a control circuit (not shown), the blade member 26 is turned to a stripping position in which a blade tip end abuts on the magnetic brush 24*a* of the charging sleeve 22, or to a retracted position in which the portion escapes from the magnetic brush 24*a* in a non-contact manner. FIG. 3A shows a state in which the blade member 26 as the charging carrier stripping member is turned to the retracted position and is detached from the magnetic brush 24*a* of the charging sleeve 22 in the non-contact manner, and this state is normally kept. FIG. 3B shows a state in which the blade member 26 is turned to the stripping position in contact with the magnetic brush 24*a*. This blade member 26 will be described later.

The cleaner 7 is disposed under the magnetic brush charging device 2, and in the present embodiment the charging device container 21 of the magnetic brush charging device 2 and the cleaning container 71 of the cleaner 7 are constituted vertically in a series so that the charging device container 21 is connected to the cleaning container 71. Photosensitive drum surface contaminants ta such as the transfer residual toner are scraped from the photosensitive drum 1 surface by the cleaning blade 72 and contained in the cleaning container 71.

The charging sleeve 22 is disposed opposite to the photosensitive drum 1 surface with the predetermined slight gap, and the opposite gap is set to be smaller than the layer thickness of the magnetic brush 24*a* so that the magnetic brush 24*a* contacts the photosensitive drum 1 and slides on the photosensitive drum surface. A contact portion between the magnetic brush 24*a* and the photosensitive drum 1 is provided with a charging carrier reservoir area of the magnetic brush 24*a*. A contact nip portion between the magnetic brush 24*a* and the photosensitive drum 1 is a charging site (charging portion) N. In the present embodiment the width of the contact nip portion as the charging portion N is set to 5 mm.

Moreover, the predetermined charging bias is applied tot he magnetic brush 24*a* via the rotated/driven charging sleeve 22 from the charging bias application power source (not shown), and the surface of the rotating photosensitive drum 1 is subjected to the contact charging process to provide the predetermined polarity/potential in the charging portion N. In the present embodiment, a direct-current voltage of −650 V is applied as the charging bias to the charging sleeve 22 to uniformly charge the photosensitive drum surface substantially in −650 V.

The charging carrier 24 provided with the following can be used for constituting the magnetic brush 24*a*.

Average particle diameter: 10 to 100 $\mu$m

Saturation magnetization: 20 to 250 emu/cm$^3$ ($8\pi\times10^{-3}$+ $0\pi\times10^{-1}$ Wb/m$^2$)

Resistance: $1\times10^2$ to $1\times10^{10}$ Ω·cm

Considering that insulation defects such as a pin hole are present in the photosensitive drum 1, a resistance of $1\times10^6$ Ω·cm or more is preferable.

Since the resistance is preferably as small as possible in order to enhance the charging property, the magnetic particles provided with the following are used in the present embodiment.

Average particle diameter: 25 $\mu$m

Saturation magnetization: 200 emu/cm$^3$ ($200\times4\pi\times10^{-4}$= $8\pi\times10^{-2}$ Wb/m$^2$)

Resistance: $5\times10^6$ Ω·cm

For the charging carrier 24 used in the present embodiment, a ferrite surface is subjected to an oxidation and reduction process and the resistance is adjusted.

Here, the resistivity of the charging magnetic particles is measured by inserting 2 g of carrier into a metal cell with a bottom area of 228 $mm^2$, subsequently applying a load of 6.6 $kg/cm^2$, and applying a voltage of 100 V.

(5) Developing Device 4

A method of developing the electrostatic latent image is generally roughly classified into the following four types.

a. A method of coating the sleeve with a nonmagnetic toner by a blade or the like, coating the sleeve with a magnetic toner by a magnetic force, carrying the toners, and developing an image with respect to the photosensitive drum in a non-contact state (mono-component non-contact developing).

b. A method of using the aforementioned coating toner with respect to the photosensitive drum in a contact state to develop the image (mono-component contact developing).

c. A method of using toner particles mixed with the magnetic carrier as a developer and carrying the developer by the magnetic force to develop the image with respect to the photosensitive drum in the contact state (two-component contact developing).

d. A method of using the aforementioned two-component developer in the non-contact state to develop the image (two-component non-contact developing).

In respect of high image quality and high image stability, the two-component contact developing method c is frequently used.

Figure 4:
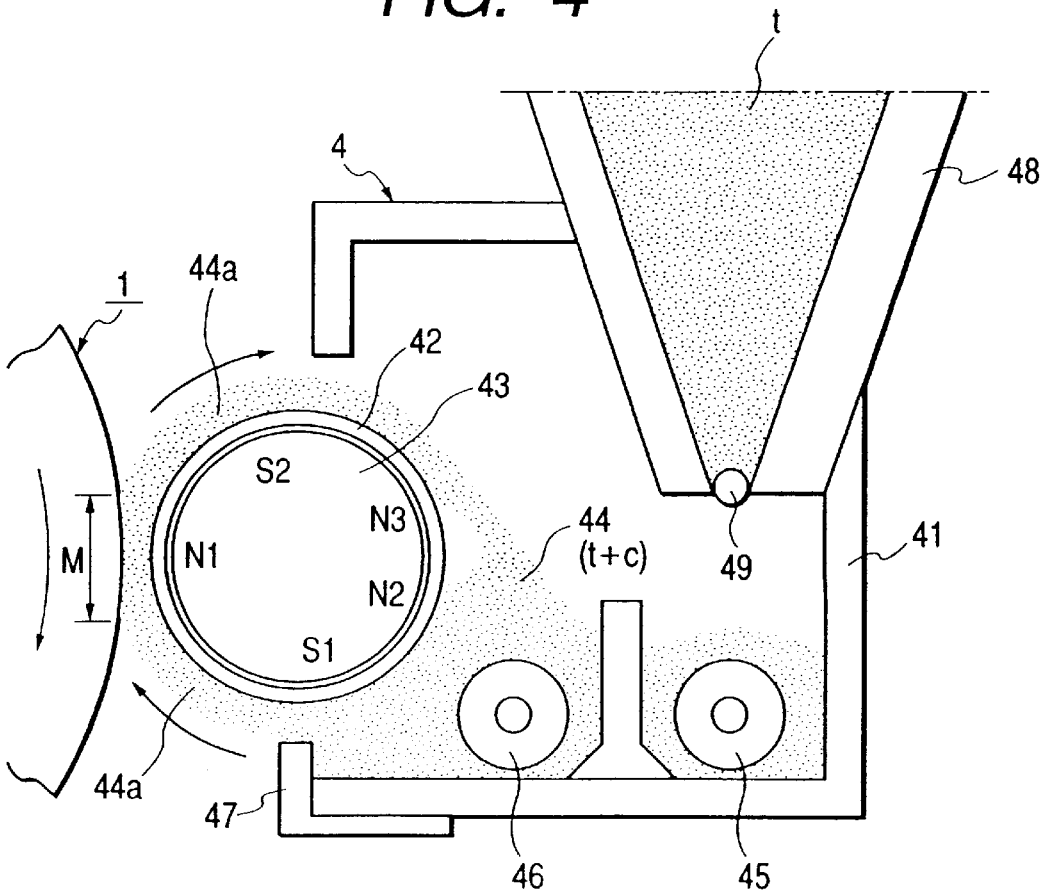
FIG. 4 is a schematic view showing a developing device.

The developing device 4 in the present embodiment is a two-component contact developing device (two-component magnetic brush developing device). An enlarged schematic view of FIG. 4 shows a developing container 41, a nonmagnetic developing sleeve 42 rotated/drive n in a clockwise direction shown by an arrow, a magnet roller 43 fixed/disposed in the developing sleeve 42, a two-component developer 44 contained in the developing container 41 and formed by mixing particles of toner t and developing magnetic particles (hereinafter referred to as the developing carrier) c, developer agitating screws 45, 46, a regulating blade 47 disposed to form the developer 44 into a thin layer on the surface of the developing sleeve 42, and a replenishing toner hopper 48 in which a replenishing toner t is contained.

The developing sleeve 42 is disposed so that an area closest to the photosensitive drum 1 is about 500 $\mu$m at least during developing, and developing is possible in a state in which a thin layer 44*a* of developer 44 formed on the surface of the developing sleeve 42 is in contact with the photosensitive drum 1. Character M denotes a developer contact area (developing portion) with respect to the photosensitive drum 1.

For the two-component developer 44 for use in the present embodiment, particles of toner t for use are obtained by applying, from the outside, titanium oxide with an average particle diameter of 20 nm at a weight ratio of 1.0%, and silica with an average particle diameter of 20 nm at a weight ratio of 1.0% to a negative charging toner with an average particle diameter of 6 $\mu$m, and the developing carrier c with a saturation magnetization of 205 $emu/cm^3$ ($8.2\pi\times10^{-2}$ $Wb/m^2$) and an average particle diameter of 35 $\mu$m is used.

Moreover, the developer 44 obtained by mixing the toner t and the developing carrier c at a weight ratio of 8:92 is used.

In this case, the toner t in the developer 44 is provided with a triboelectric charge amount of about $-25\times10^{-3}$ C/kg. Here, a method or apparatus for measuring the toner triboelectric charge (electricity) amount will be described with reference to FIG. 5.

First, the method comprises: placing a two-component agent obtained by mixing the particles of toner t whose triboelectric charge amount is to be measured and the developing carrier c at a weight ratio of 5:95 in a polyethylene bottle with a capacity of 50 to 100 ml ($5\times10^{-5}$ to $10^{-4}$ $m^3$); manually shaking the bottle for about 10 to 40 seconds; sampling about 0.5 to 1.5 g of the two-component agent; placing the sample into a metal measuring container 102 provided with a 800-mesh screen 103 on its bottom; and putting a metal cap 104.

The entire weight of the measuring container 102 is set as a weight W1 (kg).

Subsequently, in a suction device 101 (at least a portion in contact with the measuring container 102 is an insulator), suction is performed via a suction opening 107, an airflow amount adjusting valve 106 is adjusted, and a vacuum gauge 105 is set to provide a pressure of 250 mmAq ($250\times10^{-3}\times9806.65\cong2.45\times10^3$ Pa).

In this state, the suction is preferably sufficiently performed for two minutes to suck/remove resin. In this case, the potential of an electrometer 109 is set to volt (V). Here, a condenser 108 has a capacity C (F). Moreover, the entire weight of the measuring container 102 after the suction is set to a weight W2 (kg).

The triboelectric charge amount of toner is calculated as in the following equation.

$$\text{Resin triboelectric charge amount } (C/\text{kg}) = C\times V\times10^{-3}/(W1-W2)$$

A developing process of using the aforementioned developing device 4 and visualizing the electrostatic latent image on the photosensitive drum 1 by the two-component magnetic brush method and a developer. circulation system will next be described.

In FIG. 4, the developing sleeve 42 is rotated/driven in a developing portion M with a predetermined peripheral speed in a clockwise direction shown by an arrow which is counter to the rotation direction of the photosensitive drum 1. With the rotation, the developer 44 in the developing container 41 is lifted up to the surface of the developing sleeve 42 and carried by a pole N2 of the magnet roller 43, in the carrying process the layer thickness is regulated by the regulating blade 47 disposed vertically to the developing sleeve 42, and the thin layer 44*a* of the developer 44 is formed on the developing sleeve 42. A pole S1 is a carrying pole. When the developer formed as the thin layer 44*a* is carried to a pole N1 as a developing pole for the developing portion M, the developer stands like the ears by the magnetic force. The electrostatic latent image on the rotary photosensitive drum surface is developed as the toner image in the developing portion M by the toner t in the developer formed like the ears. In the present embodiment the electrostatic latent image is reversal-developed.

The developer thin layer 44*a* on the developing sleeve 42 passed through the developing portion M is returned and carried into the developing container 41 with the rotation of the developing sleeve 42. A pole S2 is a carrying pole. The developer thin layer 44*a* returned/carried into the developing container 41 is detached from the developing sleeve 42 by a repulsion magnetic field of poles N3 and N2 which have the same polarity and which are adjacent to each other, and is collected to the pooled developer in the developing container 41.

The direct-current voltage and alternating-current voltage are applied to the developing sleeve 42 from the developing bias application power source (not shown). In the present embodiment, the following is applied.

Direct-current voltage; −480 V

Alternating-current voltage; Vpp=1500 V, Vf=3000 Hz

Usually in the two-component developing method when the alternating-current voltage is applied, the developing efficiency increases, the image is high-graded, but conversely there is a danger that fog easily occurs. Therefore, the fog is usually prevented by making a potential difference between the direct-current voltage applied to the developing device 4 and the surface potential of the photosensitive drum 1. Specifically, applied is a bias voltage with a potential between the potential of the developing portion of the photosensitive drum 1 and the potential of the non-exposing portion.

This potential difference for preventing the fog is called a fog removing potential (Vback), this potential difference prevents the toner from adhering to a non-image area (non-exposing portion) on the photosensitive drum surface during developing of the rotary photosensitive drum surface, and the transfer residual toner on the photosensitive drum surface is collected by the potential difference in the apparatus of the cleanerless system (cleaning simultaneous with developing).

For the developer 44 in the developing container 41, a toner density is monitored by a sensor (not shown) for detecting the toner density. When the toner t in the developer 44 is consumed by developing the latent image and the toner density lowers below a predetermined density level, a toner supply roller 49 of the replenishing toner hopper 48 is driven/controlled and the developing container 41 is replenished with the toner t in the replenishing toner hopper 48. The toner t replenished into the developing container 41 is uniformly agitated/mixed into the developer 44 by the agitating screws 45, 46. This toner replenishing operation always maintains/manages the toner density of the developer 44 in the developing container 41 in a predetermined level range. In the present embodiment, the toner hopper 48 has a capacity for containing 500 g of toner t.

In the present embodiment, since the two-component developing is employed, inductance of the developer 44 is detected, the mixture ratio of the toner t and developing carrier c is monitored and the replenishment of the toner is performed so that the ratio is kept to be constant.

(6) Replenishment with Toner t and Replenishment with Charging Carrier 24

As described above, the toner t in the toner hopper 48 of the developing device 4 as developing means is consumed by successive replenishment with the developer 44 in the developing container 41. Toner residual amount detecting means (not shown) detects that the toner residual amount in the toner hopper 48 decreases to its predetermined lower limit amount, and detection information is inputted to the control circuit (not shown). The control circuit operates alarming/displaying means (not shown) based on the input signal and urges an operator to replenish the toner hopper 48 with the toner. The operator performs toner replenishing operation to the toner hopper 48 based on the operation of the alarming/displaying means. Thereby, the image forming apparatus can be used until the toner in the toner hopper 48 is consumed and decreases to the predetermined lower level.

On the other hand, as described above, in the image forming apparatus of the magnetic brush contact charging system and transferring system, when image formation is repeated, contamination occurs with the charging carrier of the magnetic brush 24*a* as the contact charging member of charging means, it is impossible to charge the photosensitive drum 1 as the image bearing member to a desired potential, charging unevenness occurs, and image defects are caused. The charging unevenness and image defects can be prevented by also replenishing the magnetic brush 24*a* as the contact charging member of charging means with new charging magnetic particles to re fresh the magnetic brush 24*a* before contamination of the charging carrier of the magnetic brush 24*a* excessively progresses.

Therefore, in the present invention, noting the toner replenishing operation to the developing means by a developer replenishing container, in addition to a toner containing chamber for containing the toner to replenish the developing means, the developer replenishing container is further provided with a magnetic particle containing chamber for containing magnetic particles to replenish the charging means, the charging means is also replenished with charging magnetic particles by the developer/charging magnetic particle replenishing container for every toner replenishing operation to the developing means to refresh the contact charging member using the magnetic particles, that is, the magnetic brush, deterioration of charging property by duration contamination of the magnetic brush magnetic particles can be prevented over a long period, and it is always possible to obtain a satisfactory image.

In the present embodiment, character C denotes a replenishing container attaching portion, and 12 denotes a developer/charging magnetic particle replenishing container attached to the attaching portion.

Figure 6:
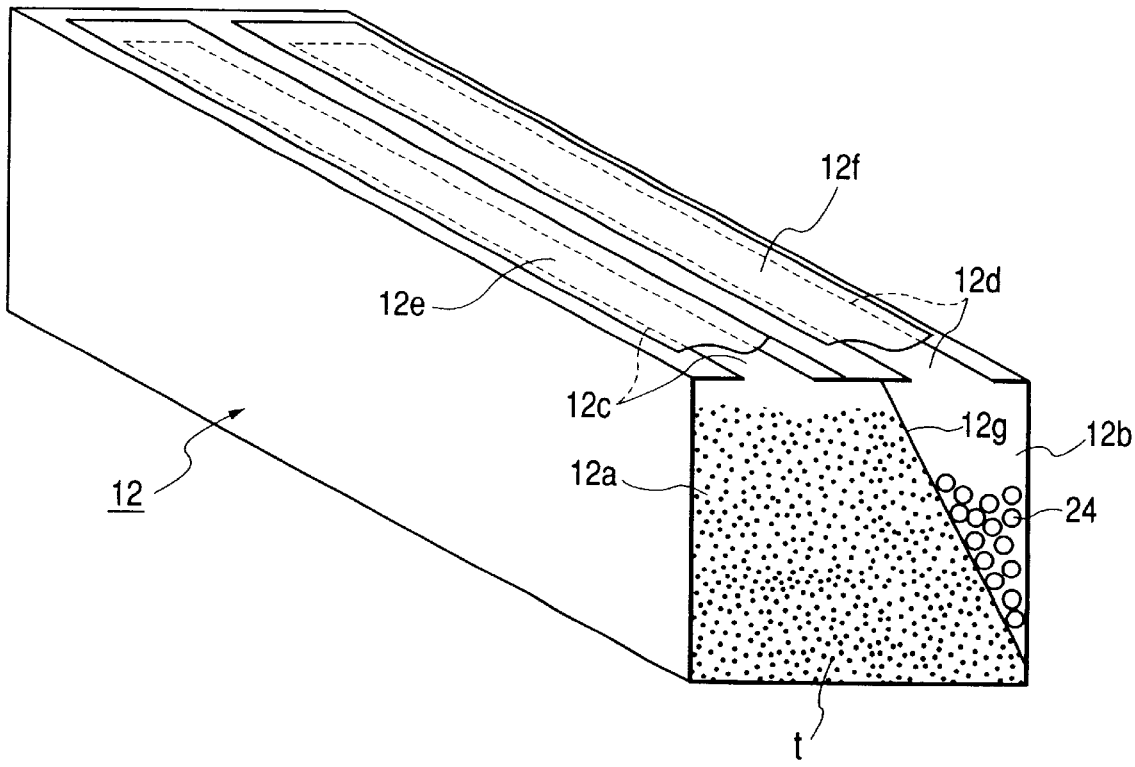
FIG. 6 is a cutout perspective view of a developer and charging magnetic particle replenishing container.

FIG. 6 is a perspective schematic view of the developer/charging magnetic particle replenishing container 12, and shows the inside of one end in a cutaway manner. The inside of the replenishing container 12 is divided by a partition plate 12*g* into a toner containing chamber 12*a* for containing the toner t to replenish the toner hopper 48 of the developing device 4, and a magnetic particle containing chamber 12*b* for containing the charging carrier (charging magnetic particles) 24 to replenish the charging device 2.

The toner containing chamber 12*a* is set to be larger than the magnetic particle containing chamber 12*b*, and 500 g of toner is contained in the present embodiment. This 500 g of toner corresponds to output of about 25,000 sheets when the toner consumption amount per sheet is 0.02 g, and corresponds to output of about 5,000 sheets when the toner consumption amount per sheet is 0.102 g.

In the present embodiment 5 g of charging carrier 24 is contained in the magnetic particle containing chamber 12*b*. When the developing device 2 is replenished with 5 g of charging carrier at consumption of every 500 g of toner, the magnetic brush 24*a* is refreshed and can practically be used with the replenishment amount until the next consumption of 500 g of toner.

Numeral 12*c* denotes a toner discharge opening for discharging the toner t contained in the toner containing chamber 12*a*, 12*d* denotes a magnetic particle discharge opening for discharging the charging carrier 24 contained in the magnetic particle containing chamber 12*b*, and the openings are disposed on the bottom surface of the replenishing container 12. Numeral 12*e* denotes an opening/closing member for openably closing the toner discharge opening 12*c*, and 12*f* denotes an opening/closing member for openably closing the magnetic particle discharge opening 12*d*. In the present embodiment the opening/closing members 12*e*, 12*f* are tape members which are sized or welded to the toner discharge opening 12*c* and magnetic particle discharge opening 12*d* to close the openings, respectively, and the respective openings are opened by stripping the tape members.

Figure 7A:
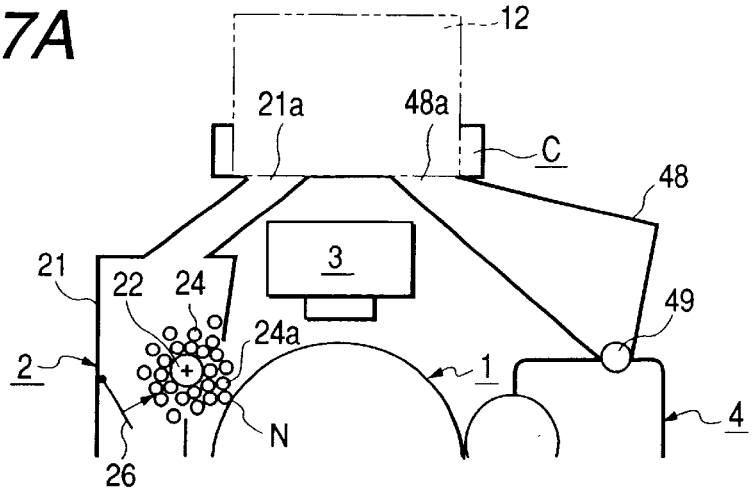
FIGS. 7A, 7B and 7C are explanatory views showing a replenishing operation of a toner and a charging carrier.

In the replenishing container attaching portion C, as shown in FIG. 7A, a toner replenishment opening 48*a* connected into the toner hopper 48 of the developing device 4, and a magnetic particle replenishment opening 21*a* connected into the charging container 21 of the charging device 2 are opened upward.

As described above, when the toner residual amount in the toner hopper 48 of the developing device 4 lowers to the predetermined lower limit amount and the control circuit operates the alarming/discharging means to urge the toner replenishment, the operator removes the remaining empty developer/charging magnetic particle replenishing container 12 from the replenishing container attaching portion C (FIG. 7A).

To the replenishing container attaching portion C a new developer/charging magnetic particle replenishing container 12 is attached in a predetermined manner by directing downward the bottom provided with the toner discharge opening 12*c* and magnetic particle discharge opening 12*d* closed by the tape members 12*e*, 12*f* as the opening/closing members.

Figure 7B:
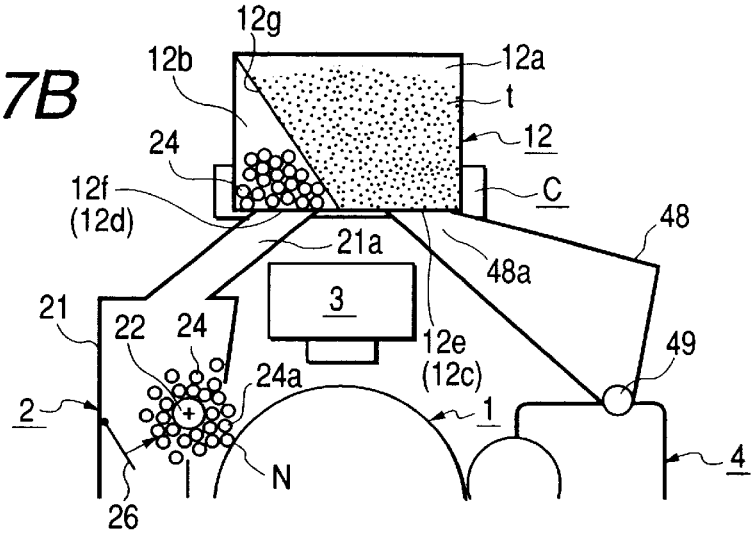

FIG. 7B shows an attached state, in which the toner discharge opening 12*c* and magnetic particle discharge opening 12*d* on the bottom side of the replenishing container 12 are positioned opposite to the toner replenishment opening 48*a* and magnetic particle replenishment opening 21*a* of the attaching portion C.

Figure 7C:
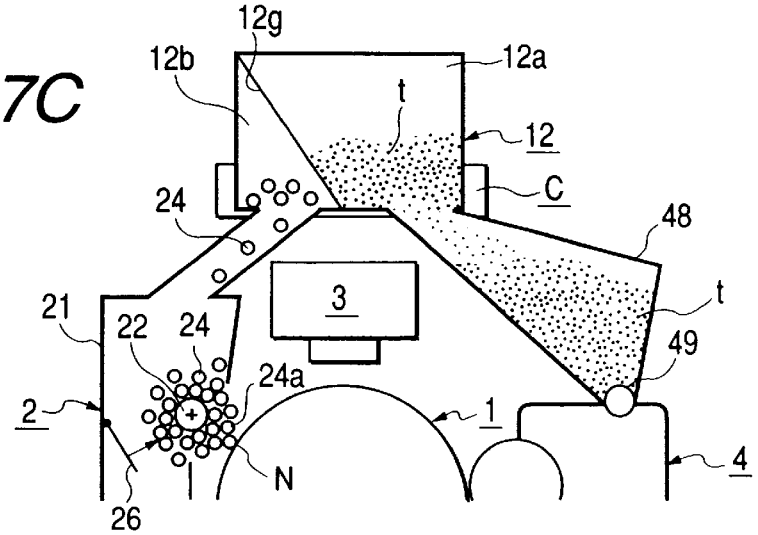

Subsequently, by successively or simultaneously stripping the tape members 12*e* and 12*f* as the opening/closing members which close the toner discharge opening 12*c* and magnetic particle discharge opening 12*d* of the developer/charging magnetic particle replenishing container 12, the toner discharge opening 12*c* and magnetic particle discharge opening 12*d* are opened. FIG. 7C shows an opened state.

When the toner discharge opening 12*c* of the replenishing container 12 is opened, the replenishing toner t in the toner containing chamber 12*a* flows down into the toner hopper 48 of the developing device 4 from the toner replenishment opening 48*a* and is replenished into the toner hopper 48.

When the magnetic particle discharge opening 12*d* of the replenishing container 12 is opened, 5 g of new replenishing charging carrier 24 in the magnetic particle containing chamber 12*b* flows down into the charging container 21 of the charging device 2 from the magnetic particle discharge opening 12*d* and is replenished to the pooled charging carrier 24 on the charging sleeve 22. This replenishment refreshes the magnetic brush 24*a*.

In the present embodiment, during replenishment of the charging carrier 24, the blade member 26 is turned to the stripping position in contact with the magnetic brush 24*a* as shown in FIG. 3B and the charging carrier of the magnetic brush 24*a* is stripped by the amount substantially corresponding to the replenishment amount. The charging carrier stripped from the magnetic brush 24*a* drops into the cleaning container 71 of the cleaner 7 and is contained in the present embodiment. The blade member 26 having stripped a predetermined amount of charging carrier from the magnetic brush 24*a* is again turned to the retracted position escaping from the layer of the magnetic brush 24*a* of the charging sleeve 22 in a non-contact manner.

By the replenishing operation of the charging carrier 24 into the charging device container 21, and the stripping operation of the charging carrier from the magnetic brush 24*a*, the charging carrier of the magnetic brush 24*a* formed and carried on the charging sleeve 22 is partially replaced, the magnetic brush 24*a* is further refreshed, and the deteriorated charging property is improved.

For the stripping operation of the charging carrier from the magnetic brush 24*a* by rocking of the blade member 26, a sequence may comprise executing the operation during replenishing of the toner and charging carrier, or may comprise executing the operation during restarting of the printer after the replenishing of the toner and charging carrier.

Even in the image forming apparatus provided with the cleaner 7 for removing the contaminants such as the transfer residual toner remaining on the rotary photosensitive drum surface after the toner image is transferred (after the transferring material is separated), as in the printer of the aforementioned embodiment, fine developer powder or external application agent powder with a micro particle diameter is not easily transferred to the transferring material and easily remains on the photosensitive drum surface, and easily slips off cleaning means.

Therefore, with the continuous rotation of the photosensitive drum 1 the slipped particles or the toner particles are carried to the charging portion N and mixed into the magnetic brush 24*a* by sliding against the magnetic brush 24*a* as the contact charging member of the magnetic brush charging device 2.

The toner mixed into the magnetic brush 24*a* is adjusted to provide a normal charging polarity (negative polarity in the present embodiment) by triboelectric charging with the charging carrier of the magnetic brush 24*a*, and is again discharged onto the photosensitive drum 1 from the magnetic brush 24*a* (because the triboelectric potential is slightly lower than the applied bias). The toner discharged onto the photosensitive drum 1 from the magnetic brush 24*a* in this manner reaches the developing portion M and is collected to the developing device 4 simultaneously with developing by the fog removing potential Vback in the developing process.

When image output is performed in the aforementioned process, the toner having slipped off the cleaner 7 is temporarily collected to the magnetic brush 24*a* as the contact charging member of the magnetic brush charging device 2, and again returned to the photosensitive drum 1. Therefore, in long duration, the toner is fused to adhere or the external application agent adheres to the charging carrier of the magnetic brush 24*a* by the sliding of the charging carrier of the magnetic brush 24*a* against the toner or the external application agent (contamination of the charging carrier by duration), the resistance of the charging carrier is raised, and image defects are caused by deterioration of the charging property.

Figure 8:
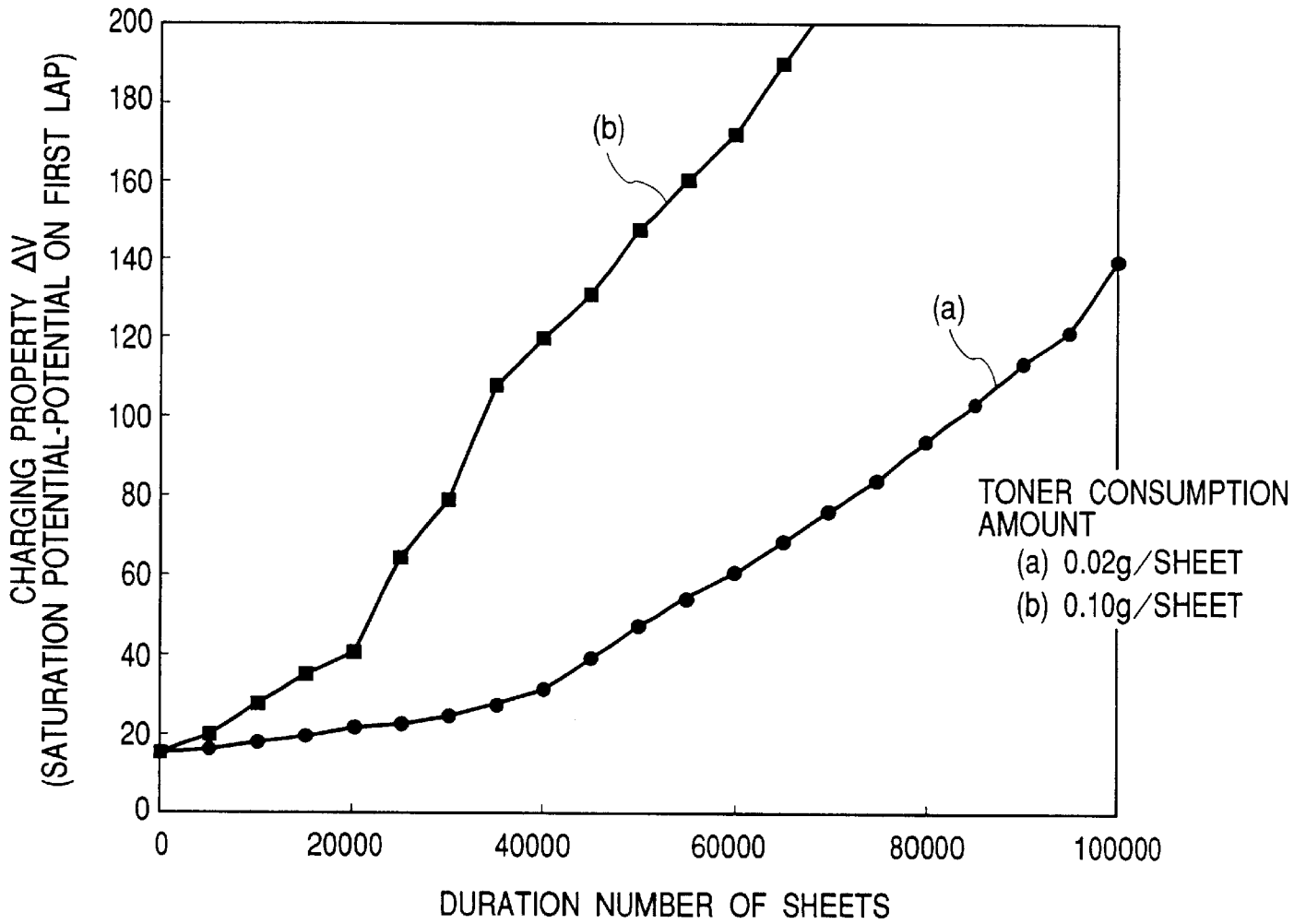
FIG. 8 is a graph showing a charging property fluctuation by contamination with duration of a magnetic brush charging carrier.

Here, FIG. 8 shows a fluctuation of charging property $\Delta V$ (difference between saturation potential and potential chargeable on a first lap) with duration of 100,000 sheets of the magnetic brush charging device 2. The smaller value of $\Delta V$ indicates better charging property. When the charging can be performed to provide a value close to a desired charging potential on the first lap, uniform charging can be performed without leaving the history of the previous lap.

In FIG. 8, (a) shows a case in which the toner consumption amount per sheet is 0.02 g, (b) shows a case in which the toner consumption amount per sheet is 0.10 g, and the fluctuation of the charging property is checked by changing the image ratio. In either case every time the toner in the toner hopper 48 of the developing device 4 is used up, the toner is replenished, but the replenishment or exchange of the charging carrier to the charging device 2 is not performed. Therefore, in either case the duration contamination of the charging carrier of the magnetic brush 24*a* progresses.

As seen from comparison of (a) with (b) in FIG. 8, the charging property is not only deteriorated depending on the number of sheets but also deteriorated quickly when the toner consumption amount increases.

It is therefore seen that in order to prevent the resistance of the charging carrier of the magnetic brush 24*a* as the contact charging member of the magnetic brush charging device 2 from increasing and to maintain the charging property, not only a countermeasure in accordance with the duration number of sheets but also a countermeasure in accordance with the toner consumption amount are necessary.

Therefore, in the present embodiment, as described above, the toner containing chamber for 500 g of toner t, and the magnetic particle containing chamber for containing 5 g of charging carrier 24 constitute the developer/charging magnetic particle replenishing container 12, and by the replenishing container 12, for every toner replenishment to the toner hopper 48 of the developing device 2, the charging carrier is replenished and replaced also to the charging device 2 by a small amount, so that the magnetic brush 24*a* is refreshed, and the deteriorated charging property is remarkably improved. As described above, during the exchange of the charging carrier, in addition to the toner replenishment, an appropriate amount of charging carrier 24 of the magnetic brush 24*a* in the charging device 2 is stripped by the blade member 26 as the stripping member, and collected into the cleaning container 71, and the charging carrier 24 in the replenishing container 12 is simultaneously supplied.

Figure 9:
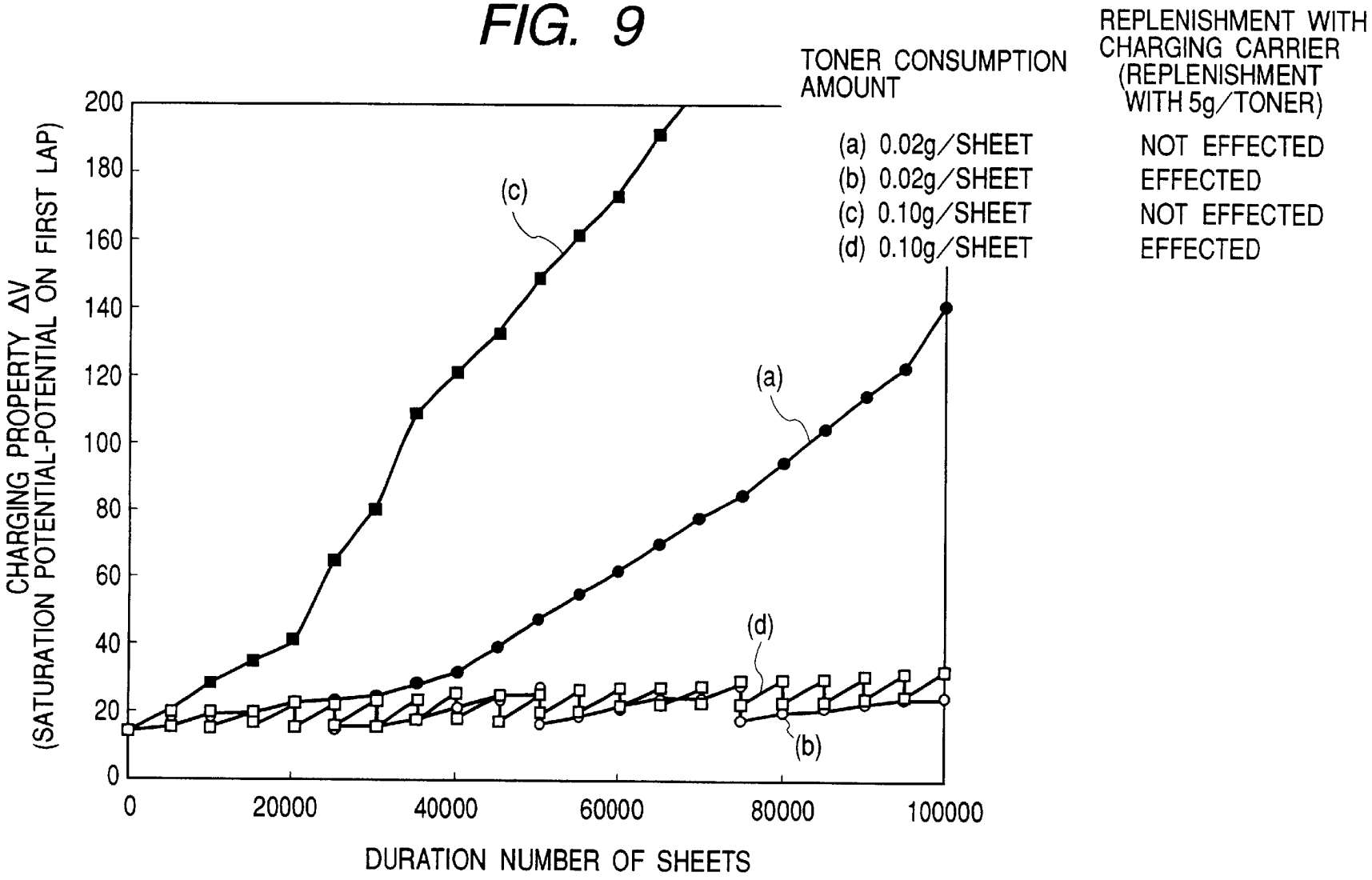
FIG. 9 is a graph showing the charging property fluctuation with the duration under various conditions in the first embodiment.

Here, similarly as FIG. 8, FIG. 9 shows the fluctuation of the charging property ΔV with the duration of 100,000 sheets, (a) shows a case in which the toner consumption amount per sheet is 0.02 g, and the replenishment or the exchange of the charging carrier is not effected at all (the same as (a) of FIG. 8), (b) shows a case in which the toner consumption amount per sheet is 0.02 g, and the replenishment or the exchange of charging carrier is effected in addition to the toner replenishment as in the present embodiment, (c) shows a case in which the toner consumption amount per sheet is 0.10 g, and the replenishment or the exchange of the charging carrier is not effected at all (the same as (b) of FIG. 8), and (d) shows a case in which the toner consumption amount per sheet is 0.10 g, and the replenishment or the exchange of charging carrier is effected in addition to the toner replenishment as in the present embodiment.

From the result of FIG. 9, as compared with (a), (c), the charging property hardly fluctuates even at 100,000 sheets in (b), (e).

In this manner, by performing the replenishment/exchange of the charging carrier to the charging device 2, in addition to the replenishment of the toner to the developing device 4, the increase of the resistivity by the fusing/adhering of toner resin or the adhering of the external application agent to the charging carrier surface of the magnetic brush 24*a* is prevented so that the resistivity is kept to be constant and the charging property of the magnetic brush charging device 2 can be maintained.

Figure 10:
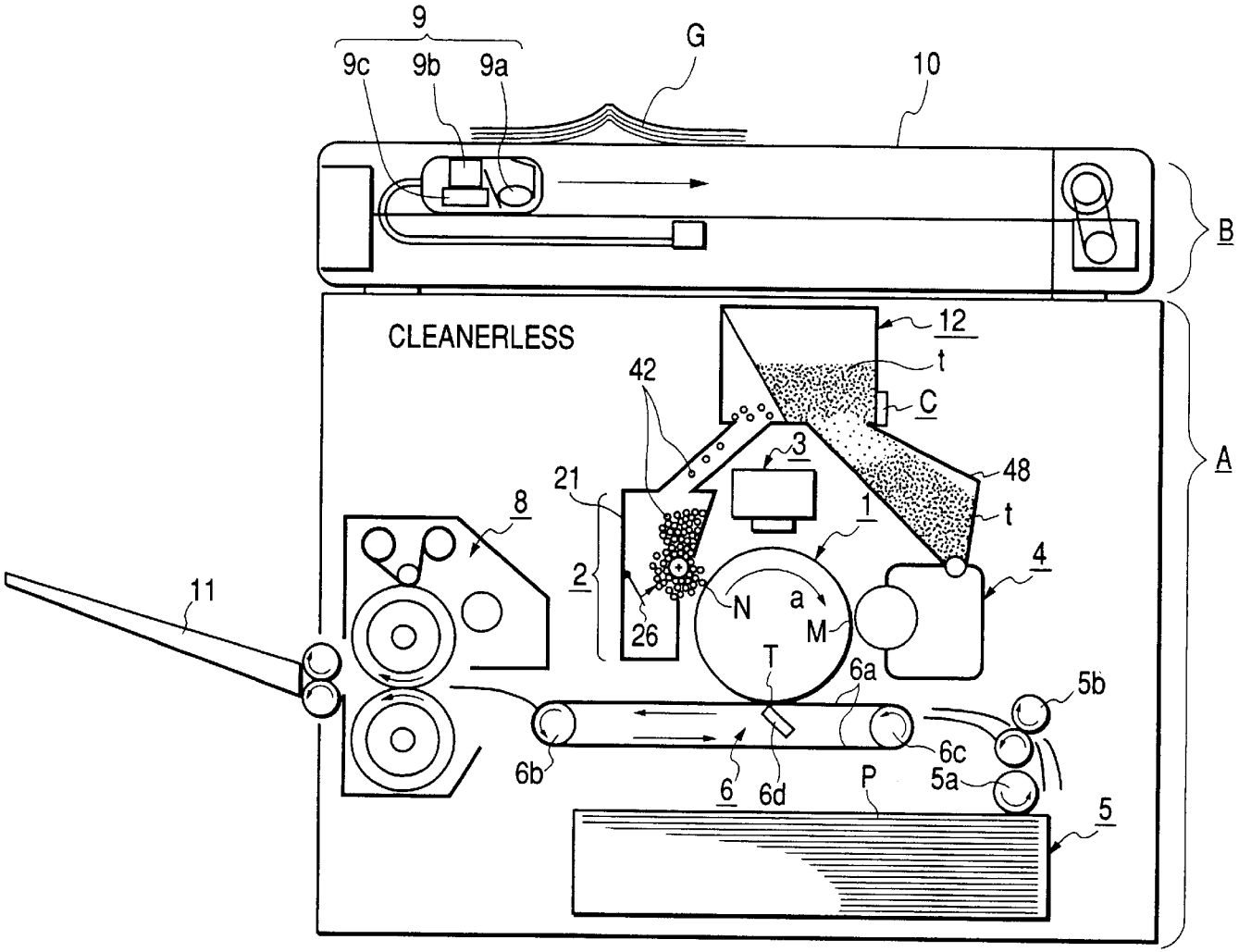
FIG. 10 is a schematic view of the image forming apparatus (cleanerless) of a second embodiment.
Figure 11:
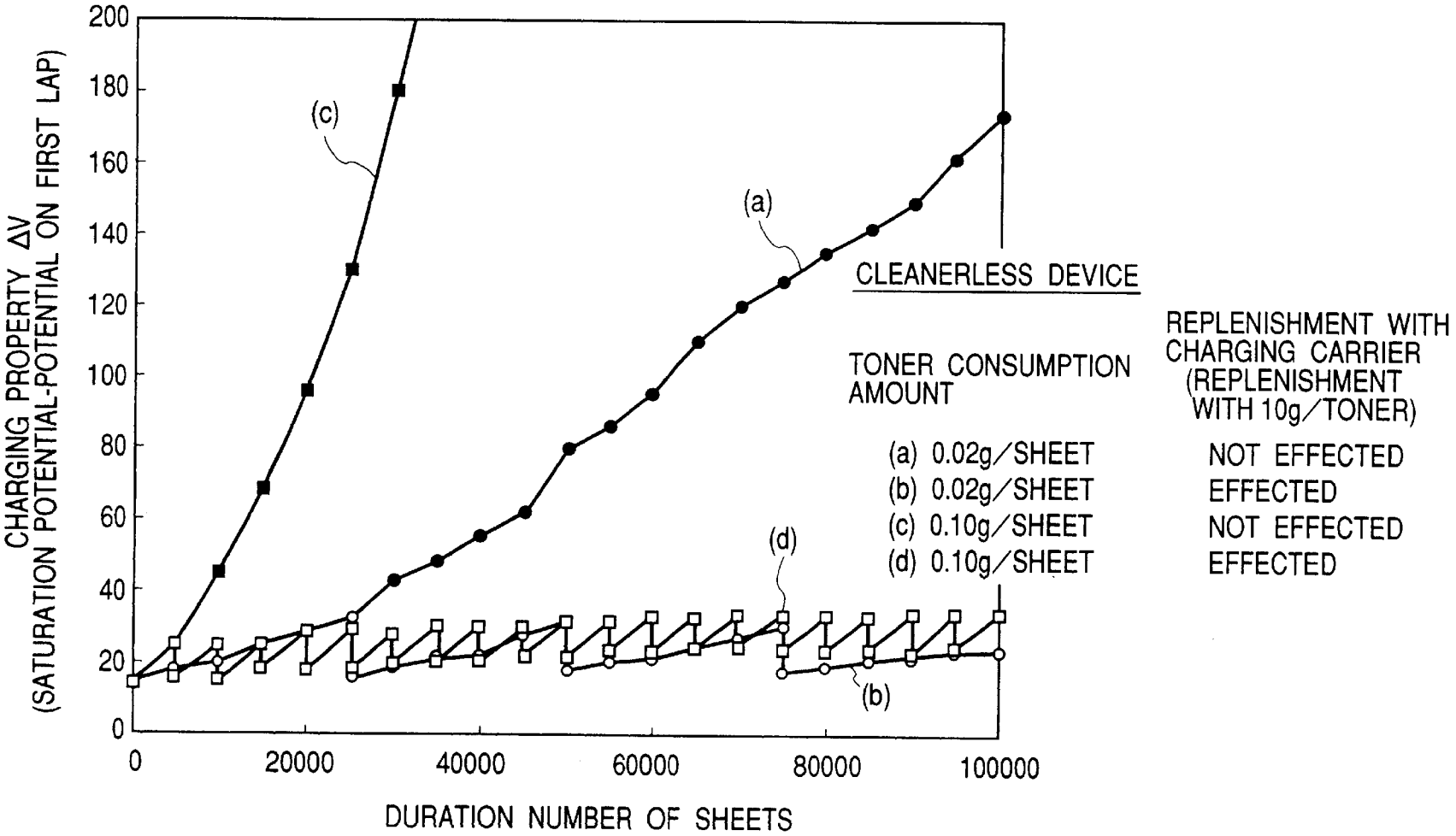
FIG. 11 is a graph showing the charging property fluctuation with the duration under various conditions in the second embodiment.

<Second Embodiment>(FIGS. 10, 11)

In the present embodiment the cleaner 7 is removed from the printer of the aforementioned first embodiment and a printer of a cleanerless system is constituted. FIG. 10 is a schematic view of the printer of the cleanerless system. Since this constitution is similar to the that of printer of the first embodiment except that there is no cleaner 7, duplicate description thereof is omitted.

The cleanerless system used in the present embodiment will briefly be described. The transfer residual toner remaining on the photosensitive drum 1 without reaching the transferring material P during toner image transferring is collected by the magnetic brush 24*a* as the contact charging member of the magnetic brush charging device 2, charged in negative polarity by the influences of the triboelectric charging with the charging carrier in the magnetic brush 24*a* and the applied bias, and discharged onto the photosensitive drum 1. The discharged toner with the negative polarity is collected to the developing device 4 simultaneously with developing and reused.

In the recovering simultaneous with developing the fog removing potential Vback during developing is utilized. In the usual developing process, by making a potential difference between the direct-current voltage applied to the developing device 4 and the surface potential of the photosensitive drum 1, fog prevention is realized. The potential difference for the fog prevention is called the fog removing potential Vback, and this potential difference prevents the toner from adhering to the non-image area on the photosensitive drum surface during developing, and the transfer residual toner is collected by the potential difference in the cleanerless apparatus.

The charging means of the photosensitive drum in the cleanerless system is not necessarily limited to the magnetic brush charging device. For example, with the charging device using the electrically conductive roller, however, since a specific surface area is small, charging defect is caused in a surface portion to which the toner adheres. Moreover, with use of a corona charging device, charging can be performed even in the presence of the toner, but transfer residual toner patterns indicating the easy adherence of a living organism with electrical discharge property and the deterioration of transfer efficiency remain, image exposing light is interrupted, or recovering defect in the developing portion occurs.

On the other hand, with use of the magnetic brush charging device 2, since the specific surface area is large, even with mixture of a slight amount of toner, the charging property is not largely deteriorated (is deteriorated in case of fusing/adhering). Additionally, since the transfer residual toner is once collected and then discharged, a way the transfer residual toner remains is not patterned. Therefore, even when the transfer efficiency is deteriorated, the interruption of the image exposing light or the recovering defect in developing does not easily occur.

When the cleanerless apparatus is used, a rise of resistivity of the charging carrier of the magnetic brush 24*a* becomes remarkable as compared with the apparatus provided with the cleaner, and the effect of the present invention is particularly large.

Also in the present embodiment, similarly as the printer of the first embodiment, the toner containing chamber for 500 g of toner t, and the magnetic particle containing chamber for containing 5 g of charging carrier 24 constitute the developer/charging magnetic particle replenishing container 12, and by the replenishing container 12, for every toner replenishment to the toner hopper 48 of the developing device 4, the charging carrier is replenished and replaced also to the charging device 2 by a small amount, so that the magnetic brush 24*a* is refreshed, and the deteriorated charging property is remarkably improved. As described above, during the exchange of the charging carrier, in addition to the toner replenishment, the appropriate amount of charging carrier 24 of the magnetic brush 24*a* in the charging device 2 is stripped by the blade member 26 as the stripping member, and the charging carrier 24 in the replenishing container 12 is simultaneously supplied.

Here, FIG. 11 shows the fluctuation of the charging property ΔV with the duration of 100,000 sheets of the magnetic brush charging device 2, (a) shows a case in which the toner consumption amount per sheet is 0.02 g, and the replenishment or the exchange of the charging carrier is not effected at all, (b) shows a case in which the toner consumption amount per sheet is 0.02 g, and the replenishment or the exchange of charging carrier is effected in addition to the toner replenishment as in the present embodiment, (c) shows a case in which the toner consumption amount per sheet is 0.10 g, and the replenishment or the exchange of the charging carrier is not effected at all, and (d) shows a case in which the toner consumption amount per sheet is 0.10 g, and the replenishment or the exchange of charging carrier is effected in addition to the toner replenishment as in the present embodiment.

From the result of FIG. 11, as compared with (a), (c), the charging property hardly fluctuates even at 100,000 sheets in (b), (d).

In this manner, in addition to the toner replenishment to the developing device 4, by performing the replenishment/exchange of the charging carrier to the charging device 2, even in the cleanerless apparatus provided with no cleaning means, the increase of the resistivity by the fusing/adhering of toner resin or the adhering of the external application agent to the charging carrier surface of the magnetic brush 24*a* is prevented so that the resistivity is kept to be constant and the charging property of the magnetic brush charging device 2 can be maintained.

Figure 12:
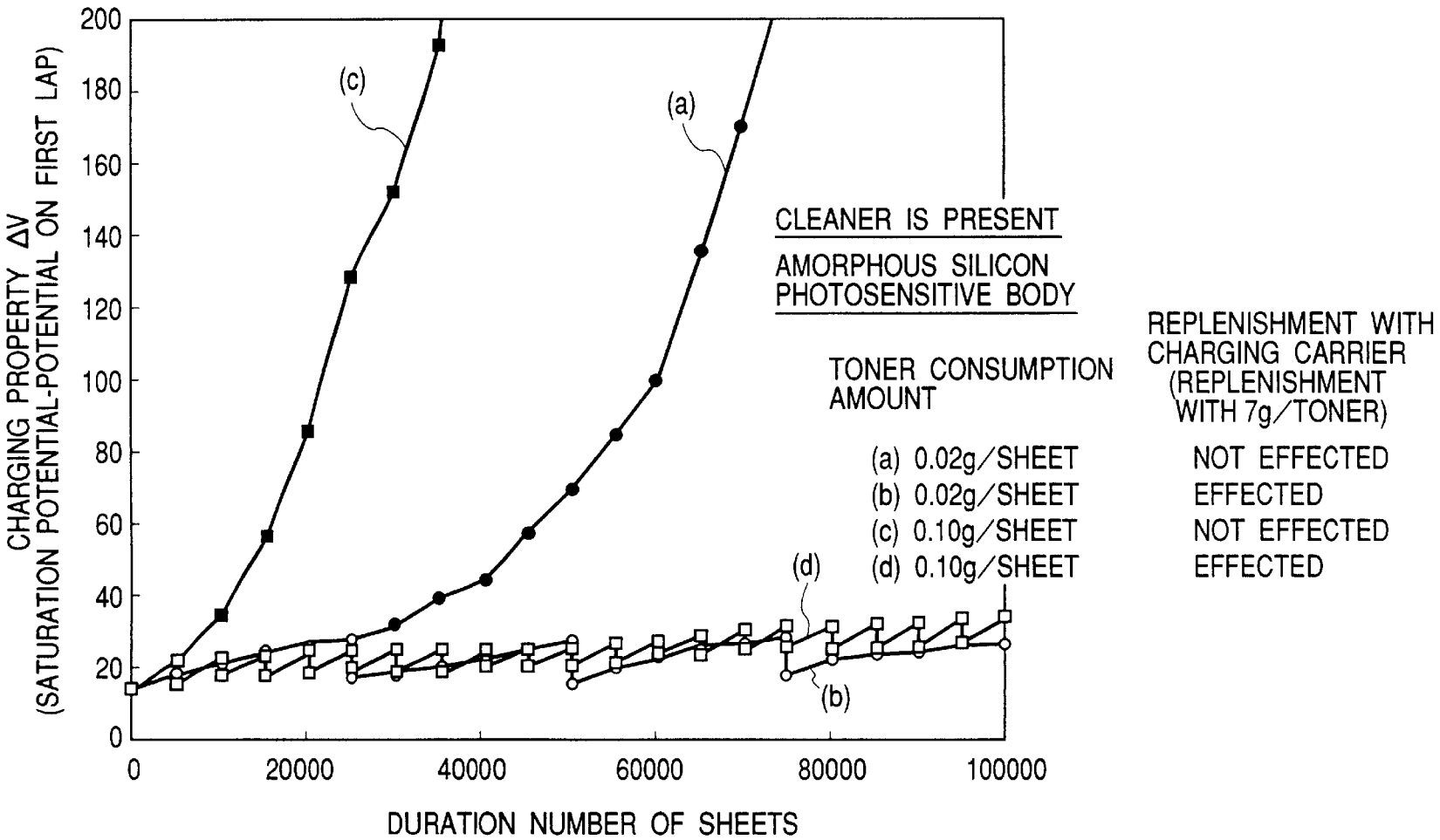
FIG. 12 is a first graph showing the charging property fluctuation with the duration under various conditions in a third embodiment.
Figure 13:
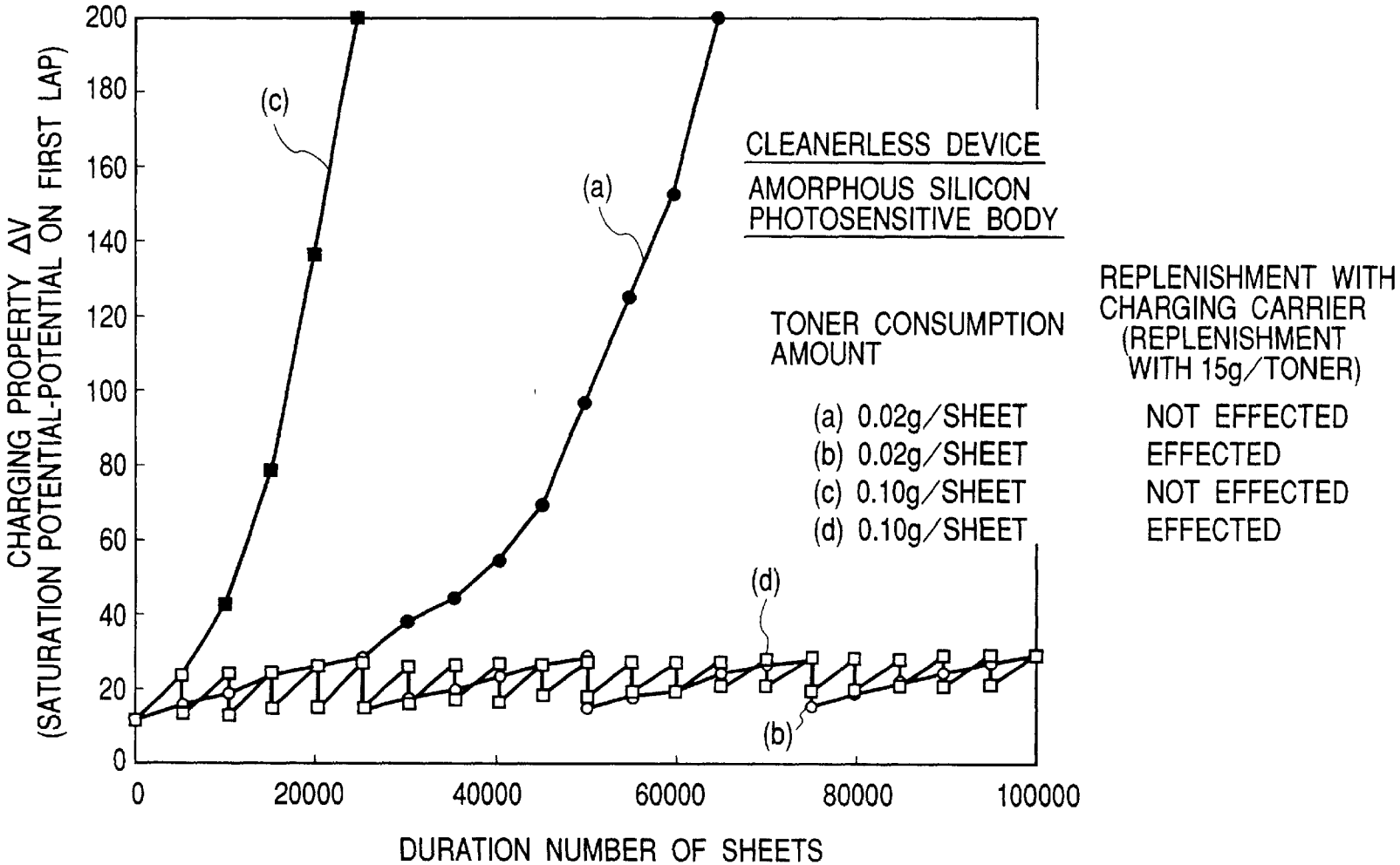
FIG. 13 is a second graph showing the charging property fluctuation with the duration under various conditions in the third embodiment.

<Third Embodiment>(FIGS. 12, 13)

In the first and second embodiments, the organic photosensitive body provided with the surface layer of the material with a resistance of $10^9$ to $10^{14}$ Ω·cm is used as the photosensitive drum 1, but in the present embodiment an amorphous silicon photosensitive body is used as the photosensitive drum 1.

Since other printer constitutions are similar to those of the printers of the first and second embodiments, duplicate description thereof is omitted.

The amorphous silicon photosensitive body is a photosensitive body in which the injection charging is possible similarly as the aforementioned organic photosensitive body, but the organic photosensitive body has a permittivity of about 3 to 4, the amorphous silicon photosensitive body has a large permittivity of the order of 11 to 12, and a drum current amount necessary during charging increases.

Therefore, in an initial duration period substantially the same charging property as that of the organic photosensitive body is obtained, but when the resistance of the charging carrier of the magnetic brush 24*a* as the contact charging member increases, the charging property is rapidly deteriorated.

Therefore, in the present embodiment, when the printer is provided with the cleaner 7 as in the first embodiment, the magnetic particle containing chamber 12*b* of the developer/charging magnetic particle replenishing container 12 contains 7 g of charging carrier 24. Moreover, with the cleanerless printer as in the second embodiment, the magnetic particle containing chamber 12*b* of the developer/charging magnetic particle replenishing container 12 contains 15 g of charging carrier 24. The amount of toner t contained in the toner containing chamber 12*a* is 500 g in either case.

According to the developer/charging magnetic particle replenishing container 12, during every toner replenishment to the toner hopper 48 of the developing device 4, by replenishing and replacing the charging carrier also to the charging device 2 by a small amount, even with the amorphous silicon photosensitive body, the charging carrier 24 is refreshed, and the deteriorated charging property is remarkably improved. During the exchange of the charging carrier, as described above, in addition to the toner replenishment, the appropriate amount of charging carrier 24 of the magnetic brush 24*a* in the charging device 2 is stripped by the blade member 26 as the stripping member, and collected in the cleaning container 71, and the charging carrier 24 in the replenishing container 12 is simultaneously supplied.

Here, FIG. 12 shows the fluctuation of the charging property ΔV with the duration of 100,000 sheets of the magnetic brush charging device 2 with respect to the printer in which the amorphous silicon photosensitive body is used as the photosensitive drum 1 and the cleaner 7 is disposed, (a) shows a case in which the toner consumption amount per sheet is 0.02 g, and the replenishment or the exchange of the charging carrier is not effected at all, (b) shows a case in which the toner consumption amount per sheet is 0.02 g, and the replenishment or the exchange of charging carrier is effected in addition to the toner replenishment as in the present embodiment, (c) shows a case in which the toner consumption amount per sheet is 0.10 g, and the replenishment or the exchange of the charging carrier is not effected at all, and (d) shows a case in which the toner consumption amount per sheet is 0.10 g, and the replenishment or the exchange of charging carrier is effected in addition to the toner replenishment as in the present embodiment.

Moreover, FIG. 13 shows the fluctuation of the charging property ΔV with the duration of 100,000 sheets with respect to the cleanerless printer in which the amorphous silicon photosensitive body is used as the photosensitive drum 1, (a) shows a case in which the toner consumption amount per sheet is 0.02 g, and the replenishment or the exchange of the charging carrier is not effected at all, (b) shows a case in which the toner consumption amount per sheet is 0.02 g, and the replenishment or the exchange of charging carrier is effected in addition to the toner replenishment as in the present embodiment, (c) shows a case in which the toner consumption amount per sheet is 0.10 g, and the replenishment or the exchange of the charging carrier is not effected at all, and (d) shows a case in which the toner consumption amount per sheet is 0.10 g, and the replenishment or the exchange of charging carrier is effected in addition to the toner replenishment as in the present embodiment.

By performing the replenishment/exchange of the charging carrier to the charging device 2 in accordance with the toner replenishment to the developing device 4 in this manner, even in the use of amorphous silicon as the photosensitive body, the increase of the resistivity by the fusing/adhering of toner resin or the adhering of the external application agent to the charging carrier surface is prevented so that the resistivity is kept to be constant and the charging property of the magnetic brush charging device 2 can be maintained.

Figure 14:
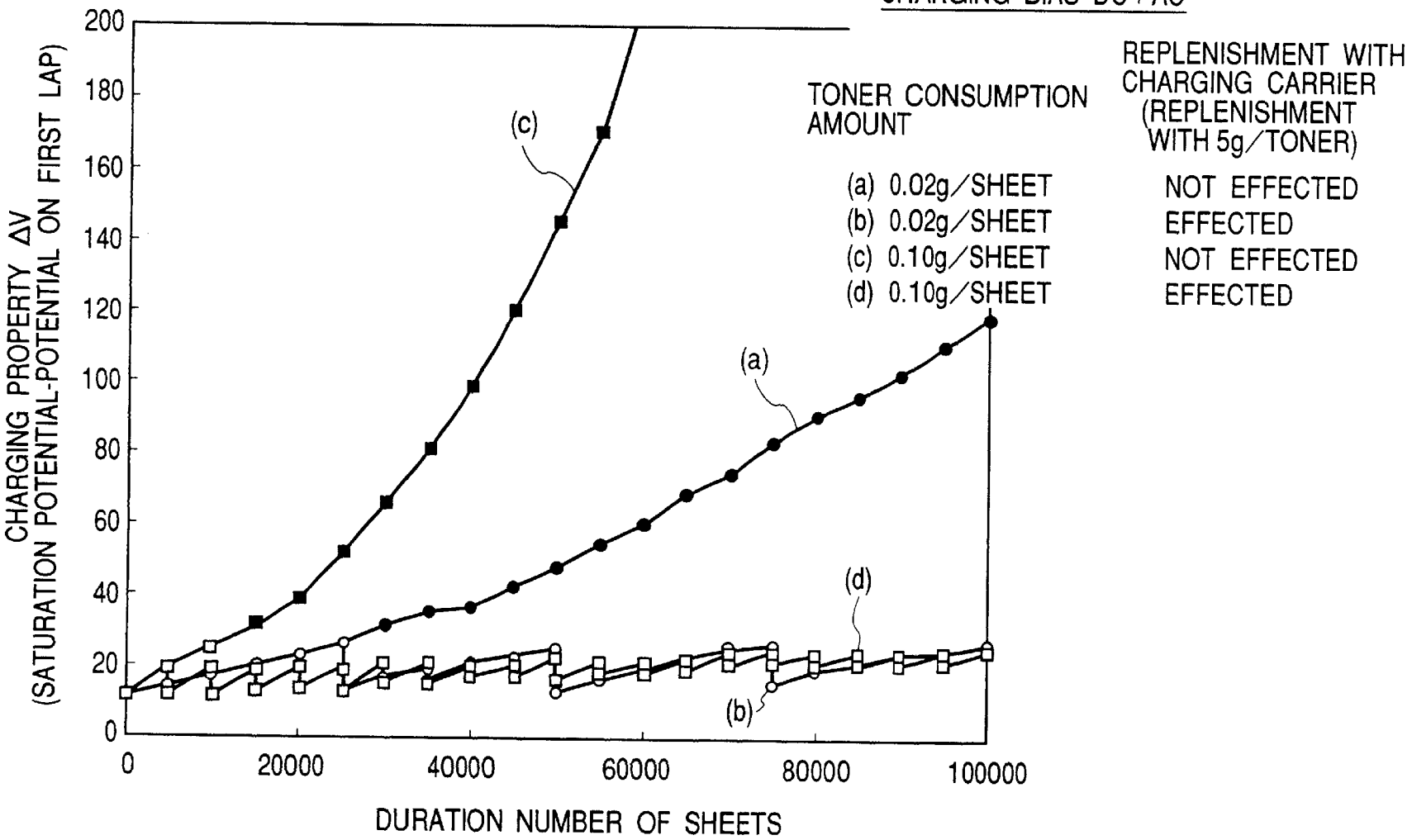
FIG. 14 is a graph showing the charging property fluctuation with the duration under various conditions in a fourth embodiment.
Figure 15:
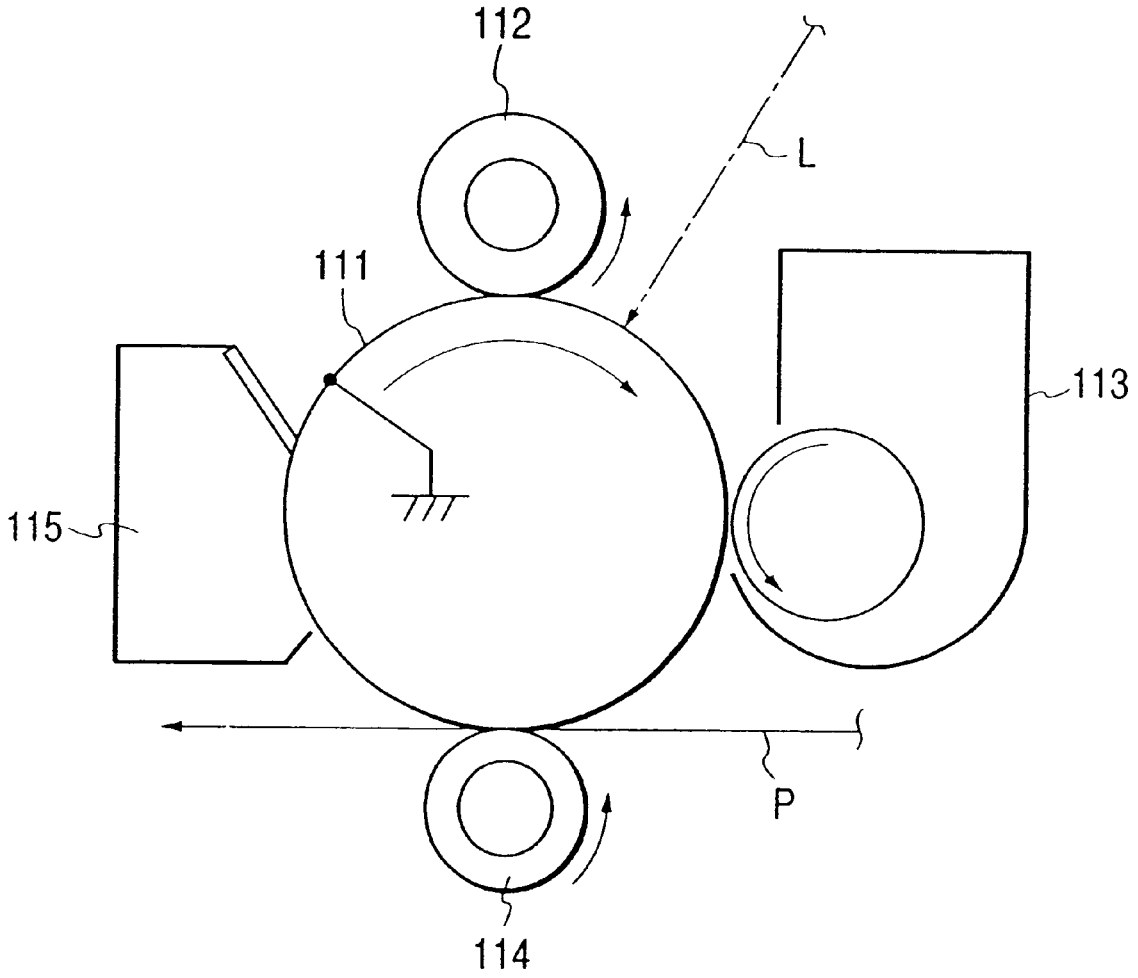
FIG. 15 PRIOR ART
FIG. 15 is a schematic view showing one example of a conventional image forming apparatus.

<Fourth Embodiment>(FIG. 14)

In the respective printers of the first, second and third embodiments, the charging of the photosensitive drum 1 is performed by applying a direct-current bias of −650 V as the charging bias to the charging sleeve 22 of the magnetic brush charging device 2, but in the present embodiment the charging of the photosensitive drum 1 is performed by applying a DC+AC bias obtained by superposing an alternating voltage of 1000 Hz, 700 V to the aforementioned direct-current bias as the charging bias to the charging sleeve 22 of the magnetic brush charging device 2.

The charging property is enhanced by superposing the alternating voltage to the charging bias. Additionally, for example, in the cleanerless apparatus as in the second embodiment, the efficiency of recovering and discharging of the transfer residual toner to the magnetic brush is enhanced.

FIG. 14 shows the fluctuation of the charging property $\Delta V$ with the duration of 100,000 sheets of the magnetic brush charging device 2 with respect to the printer constitution similar to that of the second embodiment, in which the DC+AC bias with the alternating voltage superposed thereto is applied as the charging bias to the charging sleeve 22 of the magnetic brush charging device 2.

In the present embodiment, since the charging property is enhanced by using the DC+AC bias with the alternating voltage applied thereto as the charging bias, in the replenishing container 12, 500 g of toner and 5 g of charging carrier are contained, and in accordance with the toner replenishment, the charging carrier is replenished or replaced by a small amount.

In FIG. 14, (a) shows a case in which the toner consumption amount per sheet is 0.02 g, and the replenishment or the exchange of the charging carrier is not effected at all, (b) shows a case in which the toner consumption amount per sheet is 0.02 g, and the replenishment or the exchange of charging carrier is effected in addition to the toner replenishment as in the present embodiment, (c) shows a case in which the toner consumption amount per sheet is 0.10 g, and the replenishment or the exchange of the charging carrier is not effected at all, and (d) shows a case in which the toner consumption amount per sheet is 0.10 g, and the replenishment or the exchange of charging carrier is effected in addition to the toner replenishment as in the present embodiment.

As described above, since the charging property is enhanced with the charging bias with the alternating voltage superposed thereto, the replenishment/exchange amount of charging carrier can be reduced as compared with the application of only the direct-current bias.

<Others>

1) In the respective embodiments, as the developing device 4, the two-component developing device using the two-component developer obtained by mixing the particles of toner t and charging carrier c is constituted, but the developing device 4 is not limited to the two-component developing device, and can be used in all developing methods such as the mono-component developing device.

Either a reversal developing system or a normal developing system may be used. Preferably, the mono-component contact developing or the two-component contact developing, in which developing is performed in the contact state of the developer with the photosensitive body, is effective in enhancing the effect of the recovering simultaneous with developing.

Moreover, a crushed toner or the like can be used as the toner particles in the developer. Further preferably, when a polymer toner is used, a sufficient transfer residual toner recovering effect can be obtained not only in the mono-component contact developing and two-component contact developing but also other developing methods such as mono-component non-contact developing and two-component non-contact developing.

2) Also for the toner replenishment amount and charging carrier replenishment amount, the amounts in the respective embodiments are only examples, and the effect can be obtained in all cases by replenishing the charging carrier in accordance with the toner replenishment.

3) Also for the photosensitive body, it is preferable to dispose a low resistance layer with a surface resistance of $10^9$ to $10^{14}$ $\Omega\cdot$cm in that the charge injection can be realized and ozone generation is prevented, but a sufficient effect for enhancing the durability can be obtained even in the organic photosensitive bodies other than the aforementioned bodies.

4) The stripping means of the charging carrier from the magnetic brush is not limited to the blade member 26 of the embodiment and can be arbitrary.

Furthermore, in the respective embodiments, with the replenishment of the charging carrier, the appropriate amount of used charging carrier is stripped from the magnetic brush, but substantially all the charging carrier may be stripped and replaced with a new charging carrier. Moreover, for example, when the charging carrier remarkably decreases by the adherence to the photosensitive body, the stripping does not have to be necessarily performed.

5) Moreover, also in respect of the constitution of the charging device 2, in the respective embodiments, the fixed magnet is disposed inside, and the charging carrier is conveyed by the rotation of the rotatable nonmagnetic sleeve, but the charging device is not limited to this constitution. In addition to a constitution in which the magnet itself rotates, in contact charging in which the charging carrier is used, all charging devices in which the charging carrier is supplied in accordance with the toner consumption amount are included.

6) As the waveform of the alternating-current bias component when the charging bias is applied to the contact charging member in the AC bias application system, a sine wave, a rectangular wave, a triangular wave, and the like can appropriately be used. Moreover, the alternating-current bias includes a rectangular wave voltage formed, for example, by periodically turning on/off the direct-current power source. In this case, in order to control the alternating-current bias, a peak-to-peak voltage may be controlled. In this manner, for the alternating-current bias, a bias whose voltage value periodically changes can be used.

When the developing bias applied to the developing device contains the alternating-current bias component, the alternating-current bias is also similar to the aforementioned bias.

7) The image exposing means as information writing means with respect to the charging surface of the image bearing member is not limited to the LED exposing means as in the embodiment, and usual analog image exposing means, laser scan exposing means, combination of light emitting elements such as a fluorescent lamp with a liquid crystal shutter or the like, and other means in which the electrostatic latent image can be formed in accordance with image information can be used.

The image bearing member may be an electrostatic recording dielectric body. In this case, after primary charging is uniformly performed on a dielectric body surface with the predetermined polarity or potential, electricity is selectively removed by antistatic means such as an antistatic needle head and an electron gun, and the target electrostatic latent image is written and formed.

8) As the transferring method, roller transferring, blade transferring, corona discharge transferring, and the like may be used. The present invention can also be applied to an image forming apparatus in which the transferring drum, transferring belt or another intermediate transferring body is used to form not only a monochromatic image but also a multi-color image or a full-color image by multiple transferring.

9) The apparatus can be constituted as an attachable/detachable process cartridge constitution in which the image bearing member, charging device, developing device, and other arbitrary process devices are all detachably attachable to an image forming apparatus main body.

10) There is also provided an image display apparatus in which the electrophotographic photosensitive body or the electrostatic recording dielectric body as the image bearing member is formed in a rotary belt, the toner image is formed on the image bearing member in accordance with the required image information by the charging, latent image forming, and developing means, the toner image formed portion is positioned in a perusal displaying portion to display the image, and the image bearing member is repeatedly used for forming the image to be displayed. The image forming apparatus of the present invention also includes this image display apparatus.

The embodiments of the present invention have been described, but the present invention is not restricted to these embodiments, and all modifications are possible within technical scope.

What is claimed is:

1. A replenishing container comprising:

a first chamber for containing a toner to be replenished to developing means; and a second chamber for containing magnetic particles to be replenished to charging means.

2. A replenishing container according to claim 1, wherein said second chamber is adjacent to said first chamber.

3. A replenishing container according to claim 1, further comprising a first opening for discharging the toner from said first chamber, a first sealing member for sealing said first opening, a second opening for discharging the magnetic particles from said second chamber, and a second sealing member for sealing said second opening.

4. A replenishing container according to claim 3, wherein said first and second sealing members comprise tape members.

* * * * *

UNITED STATES PATENT AND TRADEMARK OFFICE

CERTIFICATE OF CORRECTION

PATENT NO. : 6,330,411 B1
DATED : December 11, 2001
INVENTOR(S) : Hiroyuki Suzuki It is certified that error appears in the above-identified patent and that said Letters Patent is hereby corrected as shown below:

Column 8,
Line 35, "tot" should read -- to --;
Line 36, "he" should read -- the --; and
Line 51, "pin hole" should read -- pinhole --.

Column 9,
Line 24, "In respect of" should read -- With respect to --; and
Line 31, "rotated/drive n" should read -- rotated/driven --.

Column 10,
Line 32, "developer." should read -- developer --.

Column 11,
Line 42, "to be" should be deleted.

Column 12,
Line 4, "re fresh" should be -- refresh --.

Column 13,
Line 1, "into" should read -- to --; and
Line 3, "into" should read -- to --.

Column 15,
Line 28, "sheets," should read -- sheets: --; and
Line 56, "to be" should be deleted.

Column 16,
Line 11, "recovering" should read -- recording --, and "fog" should read -- fog, --.

Column 17,
Line 2, "device 2," should read -- device 2: --;
Line 29, "to be" should be deleted; and
Line 47, "of" (first occurrence) should read -- in --.

Column 18,
Line 16, "is disposed," should read -- are disposed: --;
Line 35, "drum 1," should read -- drum 1: --; and
Line 59, "to be" should be deleted.

UNITED STATES PATENT AND TRADEMARK OFFICE

CERTIFICATE OF CORRECTION

PATENT NO. : 6,330,411 B1
DATED : December 11, 2001
INVENTOR(S) : Hiroyuki Suzuki It is certified that error appears in the above-identified patent and that said Letters Patent is hereby corrected as shown below:

Column 19,
Line 8, "of" (second occurrence) should be deleted.

Column 20,
Line 18, "all" should read -- all of --; and
Line 23, "in respect of" should read -- with respect to --.

Signed and Sealed this

Twenty-third Day of April, 2002

*Attest:*

*Attesting Officer*

JAMES E. ROGAN
*Director of the United States Patent and Trademark Office*